US012661562B2

(12) United States Patent
Ines et al.

(10) Patent No.: US 12,661,562 B2
(45) Date of Patent: Jun. 23, 2026

(54) GOLF CLUB INCLUDING SWIVELABLE WEIGHT

(71) Applicant: Acushnet Company, Fairhaven, MA (US)

(72) Inventors: Marni D. Ines, San Marcos, CA (US); Kevin Tassistro, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 455 days.

(21) Appl. No.: 18/316,642

(22) Filed: May 12, 2023

(65) Prior Publication Data

US 2024/0066368 A1 Feb. 29, 2024

Related U.S. Application Data

(63) Continuation-in-part of application No. 18/296,524, filed on Apr. 6, 2023, which is a continuation-in-part of application No. 17/898,896, filed on Aug. 30, 2022, now Pat. No. 11,911,672.

(51) Int. Cl.

| | |
|---|---|
| ***A63B 53/06*** | (2015.01) |
| ***A63B 53/08*** | (2015.01) |
| *A63B 53/04* | (2015.01) |

(52) U.S. Cl.

CPC ..... *A63B 53/06* (2013.01); *A63B 53/08* (2013.01); *A63B 53/047* (2013.01); *A63B 2053/0479* (2013.01); *A63B 2053/0491* (2013.01)

(58) Field of Classification Search

CPC ..... A63B 2053/491; A63B 2053/0491; A63B 2053/0495

See application file for complete search history.

(56) References Cited

U.S. PATENT DOCUMENTS

| | | | | | |
|---|---|---|---|---|---|
| 645,942 | A | * | 3/1900 | Cran | A63B 53/047 473/336 |
| 1,213,382 | A | * | 1/1917 | Kent | A63B 60/00 403/381 |
| 2,155,830 | A | * | 4/1939 | Howard | A63B 60/52 473/246 |
| 2,460,445 | A | * | 2/1949 | Bigler | A63B 53/08 473/336 |
| 3,199,874 | A | * | 8/1965 | Blasing | A63B 53/0466 473/335 |
| 3,610,630 | A | * | 10/1971 | Glover | A63B 53/08 473/338 |

(Continued)

FOREIGN PATENT DOCUMENTS

| | | | | | |
|---|---|---|---|---|---|
| CN | 113491863 | A | * | 10/2021 | A63B 53/04 |
| CN | 215841488 | U | * | 2/2022 | A63B 53/0466 |

(Continued)

*Primary Examiner* — Alvin A Hunter

(74) *Attorney, Agent, or Firm* — Mike S. Kim

(57) ABSTRACT

A golf club head with an improved adjustable weighting system for an iron and/or wedge type golf club head is disclosed herein. In accordance with the presently disclosed technology, the golf club head may include a body portion. The body portion may include a face, a sole, and a back portion, and a rear cavity formed near the sole. The golf club head may also include a weight assembly. The weight assembly may include a cover and an adjustable weight installable underneath the cover.

17 Claims, 29 Drawing Sheets

(56) References Cited

U.S. PATENT DOCUMENTS 4,340,230 A * 7/1982 Churchward ..... A63B 53/04 473/339
5,916,042 A * 6/1999 Reimers ..... A63B 53/04 473/345
6,015,354 A * 1/2000 Ahn ..... A63B 53/04 473/341
6,277,032 B1 * 8/2001 Smith ..... A63B 53/047 473/336
6,616,547 B2 * 9/2003 Vincent ..... A63B 53/047 473/345
6,811,496 B2 * 11/2004 Wahl ..... A63B 53/047 473/345
6,923,734 B2 * 8/2005 Meyer ..... A63B 60/02 473/341
7,083,530 B2 * 8/2006 Wahl ..... A63B 53/047 337/350
7,108,609 B2 * 9/2006 Stites ..... A63B 53/06 473/335
7,121,956 B2 * 10/2006 Lo ..... A63B 53/047 473/335
7,166,041 B2 * 1/2007 Evans ..... A63B 53/0466 473/335
7,309,295 B2 * 12/2007 Solari ..... A63B 60/02 473/328
7,410,425 B2 8/2008 Willett et al.
7,530,903 B2 * 5/2009 Imamoto ..... A63B 60/02 473/335
7,611,424 B2 * 11/2009 Nagai ..... A63B 60/02 473/335
7,704,163 B2 * 4/2010 Stites ..... A63B 53/047 473/334
7,758,451 B2 * 7/2010 Liang ..... A63B 53/0487 473/349
7,775,905 B2 * 8/2010 Beach ..... A63B 53/0466 473/256
7,806,782 B2 * 10/2010 Stites ..... A63B 53/0466 473/409
7,871,339 B2 * 1/2011 Sanchez ..... A63B 53/047 473/335
7,927,231 B2 * 4/2011 Sato ..... A63B 53/06 473/336
8,016,694 B2 * 9/2011 Llewellyn ..... A63B 53/04 473/335
8,043,167 B2 * 10/2011 Boyd ..... A63B 60/02 473/345
8,088,019 B1 1/2012 Long et al.
8,192,303 B2 * 6/2012 Ban ..... A63B 53/0466 473/335
8,202,175 B2 * 6/2012 Ban ..... A63B 53/0466 473/345
8,206,243 B2 * 6/2012 Stites ..... A63B 60/02 473/345
8,303,433 B2 * 11/2012 Roach ..... A63B 53/0466 473/335
8,337,325 B2 * 12/2012 Boyd ..... A63B 60/02 473/332
8,409,031 B2 * 4/2013 Stites ..... A63B 60/42 473/335
8,444,505 B2 * 5/2013 Beach ..... A63B 60/00 473/335
8,574,094 B2 * 11/2013 Nicolette ..... A63B 53/04 473/290
8,696,491 B1 * 4/2014 Myers ..... A63B 60/02 473/345
8,777,774 B1 7/2014 Kim et al.
8,790,195 B1 * 7/2014 Myers ..... A63B 53/0466 473/335
8,894,506 B1 * 11/2014 Myers ..... A63B 60/52 473/335
8,968,116 B1 * 3/2015 Myers ..... A63B 60/00 473/335
9,079,080 B2 * 7/2015 Jertson ..... A63B 60/54
9,180,349 B1 * 11/2015 Seluga ..... A63B 53/0466
9,211,453 B1 * 12/2015 Foster ..... A63B 53/06
9,259,627 B1 * 2/2016 Myers ..... A63B 53/04
9,289,660 B1 * 3/2016 Myers ..... A63B 53/0466
9,364,728 B1 * 6/2016 Myers ..... A63B 60/52
9,421,438 B2 * 8/2016 Beno ..... A63B 53/06
9,440,123 B2 * 9/2016 Beno ..... A63B 60/42
9,440,126 B2 * 9/2016 Boyd ..... A63B 60/04
9,561,413 B2 * 2/2017 Nielson ..... A63B 60/00
9,597,561 B1 * 3/2017 Seluga ..... A63B 60/52
9,597,563 B2 * 3/2017 Voshall ..... A63B 53/06
9,616,301 B2 * 4/2017 Clausen ..... A63B 60/00
9,623,302 B1 * 4/2017 Myers ..... A63B 53/0466
9,636,553 B1 * 5/2017 Myers ..... A63B 60/52
9,636,556 B2 * 5/2017 Beck ..... A63B 53/06
9,682,296 B1 * 6/2017 Myers ..... A63B 53/0466
9,694,256 B2 * 7/2017 Myers ..... A63B 53/0466
9,694,261 B2 * 7/2017 Nunez ..... A63B 60/52
9,700,764 B2 * 7/2017 Carter ..... A63B 53/0466
9,707,459 B1 * 7/2017 Myers ..... A63B 60/52
9,731,175 B1 * 8/2017 Myers ..... A63B 60/04
9,757,630 B2 * 9/2017 Mata ..... A63B 53/0466
9,764,210 B2 * 9/2017 Curtis ..... A63B 53/0466
9,868,036 B1 * 1/2018 Kleinert ..... A63B 53/06
9,878,223 B2 * 1/2018 Foster ..... A63B 60/04
9,937,392 B2 * 4/2018 Myers ..... A63B 53/0487
9,993,703 B2 * 6/2018 Beck ..... A63B 60/42
10,004,956 B2 * 6/2018 Beck ..... A63B 71/0622
10,029,161 B2 * 7/2018 Knutson ..... A63B 53/06
10,065,094 B2 * 9/2018 Wallin ..... A63B 53/0466
10,071,293 B2 * 9/2018 Green ..... A63B 60/42
10,188,916 B2 * 1/2019 Harbert ..... A63B 60/00
10,213,665 B1 * 2/2019 Day ..... A63B 53/0466
10,258,839 B2 * 4/2019 Beck ..... A63B 71/0622
10,391,371 B2 * 8/2019 Luttrell ..... A63B 53/0466
10,398,952 B1 * 9/2019 Yi ..... A63B 53/0433
10,543,406 B2 * 1/2020 Carter ..... A63B 53/0466
10,556,161 B2 * 2/2020 Jertson ..... A63B 53/06
10,576,337 B2 * 3/2020 Soracco ..... A63B 60/52
10,596,428 B1 * 3/2020 Rumble ..... A63B 60/02
10,695,628 B1 * 6/2020 Yi ..... A63B 53/08
10,918,917 B2 * 2/2021 Northcutt ..... A63B 53/0466
10,926,143 B2 * 2/2021 Bennett ..... A63B 60/02
11,013,965 B2 * 5/2021 Story ..... A63B 60/00
11,052,294 B2 * 7/2021 Carter ..... A63B 60/00
11,090,536 B2 * 8/2021 Bennett ..... A63B 53/08
11,229,827 B2 * 1/2022 Yi ..... A63B 53/047
11,413,509 B2 * 8/2022 Carter ..... A63B 60/00
11,439,877 B2 * 9/2022 Northcutt ..... A63B 60/04
11,439,878 B2 * 9/2022 Bennett ..... A63B 53/047
11,439,879 B2 * 9/2022 Yi ..... A63B 60/52
11,497,974 B2 * 11/2022 Northcutt ..... A63B 53/0466
11,504,589 B2 * 11/2022 Tassistro ..... A63B 53/0475
11,684,830 B2 * 6/2023 Mizutani ..... A63B 53/0466 473/345
11,691,057 B2 * 7/2023 Bennett ..... A63B 53/08 473/335
11,813,491 B2 * 11/2023 Cleghorn ..... A63B 53/06
11,819,741 B2 * 11/2023 Oldknow ..... A63B 53/06
11,911,672 B1 * 2/2024 Hettinger ..... A63B 53/06
11,925,841 B2 * 3/2024 Yi ..... A63B 53/0466
12,005,327 B2 * 6/2024 Hettinger ..... A63B 60/02
12,070,666 B2 * 8/2024 Nielson ..... A63B 53/06
12,090,377 B2 * 9/2024 Beach ..... A63B 53/0466
12,102,895 B2 * 10/2024 Funaki ..... A63B 53/0466
12,246,227 B2 * 3/2025 Bennett ..... A63B 53/08
2005/0101408 A1 * 5/2005 Sanchez ..... A63B 53/0466 473/345
2006/0122004 A1 * 6/2006 Chen ..... A63B 53/0466 473/335
2006/0240908 A1 * 10/2006 Adams ..... A63B 60/02 473/335
2007/0135231 A1 * 6/2007 Lo ..... A63B 53/0466 473/336
2008/0020861 A1 * 1/2008 Adams ..... A63B 60/00 473/336
2008/0039228 A1 * 2/2008 Breier ..... A63B 60/00 473/345

(56) References Cited

U.S. PATENT DOCUMENTS

| | | | | |
|---|---|---|---|---|
| 2008/0261715 | A1* | 10/2008 | Carter | A63B 53/047 473/335 |
| 2010/0075773 | A1* | 3/2010 | Casati, Jr. | A63B 59/00 473/519 |
| 2013/0090185 | A1* | 4/2013 | Boyd | A63B 60/02 473/337 |
| 2014/0038746 | A1* | 2/2014 | Beach | A63B 53/0466 473/335 |
| 2015/0190687 | A1* | 7/2015 | Clausen | A63B 53/0475 473/335 |
| 2015/0306473 | A1* | 10/2015 | Breier | A63B 53/06 473/409 |
| 2015/0306475 | A1* | 10/2015 | Curtis | A63B 53/06 473/345 |
| 2015/0321055 | A1* | 11/2015 | Golden | A63B 60/42 473/334 |
| 2016/0129323 | A1* | 5/2016 | Myers | A63B 53/0466 473/338 |
| 2016/0271464 | A1* | 9/2016 | Murphy | A63B 53/06 |
| 2018/0056154 | A1* | 3/2018 | Wallin | A63B 60/02 |
| 2018/0065005 | A1* | 3/2018 | Cleghorn | A63B 53/0466 |
| 2019/0022481 | A1* | 1/2019 | Mine | A63B 60/52 |
| 2019/0192928 | A1* | 6/2019 | Soracco | A63B 60/04 |
| 2019/0329106 | A1* | 10/2019 | Luttrell | A63B 53/0466 |
| 2020/0330834 | A1* | 10/2020 | Northcutt | A63B 53/045 |
| 2020/0330835 | A1* | 10/2020 | Bennett | A63B 53/06 |
| 2020/0330836 | A1* | 10/2020 | Bennett | A63B 60/02 |
| 2021/0128994 | A1* | 5/2021 | Yi | A63B 53/047 |
| 2021/0138318 | A1* | 5/2021 | Northcutt | A63B 53/0466 |
| 2021/0138319 | A1* | 5/2021 | Bennett | A63B 53/047 |
| 2021/0299525 | A1* | 9/2021 | Mizutani | A63B 53/04 |
| 2021/0402270 | A1* | 12/2021 | Bennett | A63B 60/02 |
| 2022/0111263 | A1* | 4/2022 | Yi | A63B 53/0433 |
| 2023/0271066 | A1* | 8/2023 | Mizutani | A63B 53/0466 473/345 |
| 2023/0285817 | A1* | 9/2023 | Bennett | A63B 60/02 |
| 2023/0330499 | A1* | 10/2023 | Yi | A63B 60/52 |
| 2023/0338794 | A1* | 10/2023 | Hettinger | A63B 53/047 |
| 2024/0066366 | A1* | 2/2024 | Yi | A63B 53/047 |
| 2024/0066367 | A1* | 2/2024 | Hettinger | A63B 60/02 |
| 2024/0066368 | A1* | 2/2024 | Ines | A63B 53/08 |
| 2024/0157206 | A1* | 5/2024 | Hettinger | A63B 53/047 |
| 2024/0226673 | A1* | 7/2024 | Cleghorn | A63B 60/02 |
| 2024/0316420 | A1* | 9/2024 | Yi | A63B 53/08 |
| 2024/0316422 | A1* | 9/2024 | Yi | A63B 60/52 |
| 2024/0359064 | A1* | 10/2024 | Hettinger | A63B 53/06 |
| 2025/0025755 | A1* | 1/2025 | Yi | A63B 60/02 |

FOREIGN PATENT DOCUMENTS

| | | | | |
|---|---|---|---|---|
| CN | 115245667 | A * | 10/2022 | A63B 53/04 |
| CN | 118217607 | A * | 6/2024 | A63B 53/06 |
| EP | 4070863 | A1 * | 10/2022 | A63B 60/04 |
| EP | 4070863 | B1 * | 6/2024 | A63B 53/04 |
| EP | 4400184 | A2 * | 7/2024 | A63B 60/02 |
| FR | 2581320 | A1 * | 11/1986 | A63B 53/0433 |
| GB | 1387955 | A * | 3/1975 | A63B 53/047 |
| GB | 2094158 | A * | 9/1982 | A63B 53/04 |
| GB | 2407781 | A * | 5/2005 | A63B 53/047 |
| JP | 2729760 | B2 * | 3/1998 | |
| JP | 2005058765 | A * | 3/2005 | A63B 53/047 |
| JP | 2005296582 | A * | 10/2005 | |
| JP | 2005323978 | A * | 11/2005 | |
| JP | 2006320493 | A * | 11/2006 | |
| JP | 2007319687 | A * | 12/2007 | A63B 60/02 |
| JP | 2010069106 | A * | 4/2010 | A63B 53/0466 |
| JP | 2010136772 | A * | 6/2010 | A63B 60/02 |
| JP | 2010148702 | A * | 7/2010 | A63B 53/04 |
| JP | 2010252964 | A * | 11/2010 | |
| JP | 2012125291 | A * | 7/2012 | |
| JP | 2012139450 | A * | 7/2012 | |
| JP | 2014223548 | A * | 12/2014 | A63B 60/02 |
| JP | 2016179061 | A * | 10/2016 | A63B 53/0408 |
| JP | 2019000664 | A * | 1/2019 | A63B 53/06 |
| JP | 2019042192 | A * | 3/2019 | |
| JP | 2020175196 | A * | 10/2020 | A63B 53/047 |
| JP | 2021151381 | A * | 9/2021 | A63B 53/04 |
| JP | 2022160000 | A * | 10/2022 | A63B 53/06 |
| JP | 2023091773 | A * | 6/2023 | A63B 53/06 |
| JP | 2024035113 | A * | 3/2024 | A63B 53/06 |
| JP | 7483475 | B2 * | 5/2024 | A63B 60/02 |
| JP | 3246905 | U * | 6/2024 | A63B 53/0475 |
| JP | 3249412 | U * | 12/2024 | A63B 60/52 |
| KR | 19990076463 | A * | 10/1999 | A63B 53/0487 |
| KR | 20110033462 | A * | 3/2011 | A63B 53/047 |
| KR | 20130005384 | A * | 1/2013 | A63B 53/047 |
| KR | 101401409 | B1 * | 5/2014 | A63B 53/007 |
| KR | 20160121568 | A * | 10/2016 | A63B 53/08 |
| KR | 20220138878 | A * | 10/2022 | A63B 53/04 |
| KR | 20230094163 | A * | 6/2023 | A63B 53/06 |
| KR | 20240001700 | U * | 10/2024 | A63B 53/0475 |
| TW | 201538208 | A * | 10/2015 | A63B 53/0408 |
| WO | WO-0243819 | A2 * | 6/2002 | A63B 60/02 |
| WO | WO-2007044220 | A1 * | 4/2007 | A63B 53/06 |
| WO | WO-2015123661 | A1 * | 8/2015 | A63B 53/06 |

* cited by examiner

GOLF CLUB INCLUDING SWIVELABLE WEIGHT

RELATED APPLICATIONS

The present application is a continuation-in-part of U.S. application Ser. No. 18/296,524, which is a continuation-in-part of U.S. application Ser. No. 17/898,896, filed Aug. 30, 2022, the disclosures of which are incorporated by reference herein in their entirety.

FIELD OF THE INVENTION

The presently disclosed technology relates generally to an improved adjustable weighting system for an iron and/or wedge type golf club head. More specifically, the golf club head in accordance with the presently disclosed technology relates to an improved adjustable weighting system that allows a user to adjust a location of a weight in the golf club head and/or view a position of the weight in the golf club head.

BACKGROUND OF THE INVENTION

In the game of golf, every golfer's swing is a little different from the next one. Consequently, what is best for one golfer may not always be the best for another golfer. In one example, one golfer may require a golf club that provides a lot of forgiveness, while in another example, the other golfer may require a golf club that provides more precision. In the golfing equipment industry, different types and models of golf clubs have traditionally been provided to meet the different needs of the various golfers.

With the continued development of innovation with golf club technology, golf club designers have been capable of incorporating adjustability in a golf club head to try and meet the varying needs of a golfer. U.S. Pat. No. 8,088,019 to Long et al. illustrates an example of adding an adjustable hosel mechanism to a golf club head, allowing the loft, lie, and face angle of a golf club head to be adjusted to accommodate the needs of a golfer.

In addition to adjustable hosel technology, U.S. Pat. No. 7,410,425 to Willett et al. illustrates that weighting in a golf club head may also be adjusted via one or more weighting screws that may have different densities, altering the center of gravity of the golf club head, providing a golfer with different ball flight characteristics depending on the needs of a golfer.

U.S. Pat. No. 8,696,491 to Myers provide another way to provide adjustability in a metalwood golf club head via a track weighting system instead of plurality of individual weights, allowing a single a weight to be moved along a track in a golf club head, also manipulating the center of gravity and the performance of the golf club head.

The utilization of adjustable weighting is not only applicable in metalwood type golf club heads as shown above, but also can be used in an iron type context to achieve similar objectives. U.S. Pat. No. 6,015,354 to Ahn et al. illustrates one of the earlier efforts to adjust weighting in an iron type golf club head using various types of adjustments that are very visual. Maintaining clean visual aesthetics is a very important feature in a golf club design, as it is often associated with the confidence of a golfer.

U.S. Pat. No. 8,777,774 to Kim et al. provides a more modern day attempt to adjust the weighting of a golf club head, but this time attempting to preserve the overall look of the golf club head.

All of the above exemplary advancements in golf club head performance have been very effective in adjusting the weighting and center of gravity of a golf club head. However, despite all the advancements above, none of the references has truly provided a aesthetically pleasing way to provide adjustment of weighting and thus the center of gravity of the golf club head all while preserving the shape and look of a traditional golf club head.

BRIEF SUMMARY OF THE INVENTION

Embodiments of the presently disclosed technology may include a golf club head. In accordance with some aspects of the presently disclosed technology, a golf club head may include a body portion. The body portion may include a face. The body portion may include a sole extending rearward from the face. The body portion may include a back portion positioned rearward of the face and extending from a rearward portion of the sole. The body portion may include a rear cavity formed near the sole. The golf club head may include a weight assembly. The weight assembly may include a cover to cover the rear cavity. The cover may include a first portion, a second portion, and a through bore. The through bore may separate the first portion and the second portion. The weight assembly may include an adjustable weight installable underneath the cover. The adjustable weight may include a first end adjustably installable near the first portion. The adjustable weight may include a second end adjustably installable near the second portion. The adjustable weight may include an opening between the first end and the second end. The golf club head may include a fastener to engage the through bore to secure the cover to the body portion. The fastener may engage the opening.

In embodiments, the first end may be swivelable from near the first portion to near the second portion thereby swiveling the second end from near the second portion to near the first portion.

In embodiments, the opening may include a first end opening near the first end and a second end opening near the second end. The adjustable weight may be slidable from a first end opening to a second end opening to affect a center of gravity of the golf club head along an x-axis between about 0 mm to about 5 mm.

In embodiments, the cover may include a first material and a second material. The first material may be denser than the second material. The first material may be substantially on the first portion.

In embodiments, a first shape of the first portion may be different than a second shape of the second portion.

In embodiments, the adjustable weight may include a third material and a fourth material. The third material may be denser than the fourth material. The third material may be substantially on the first end.

In embodiments, the adjustable weight may include an integrated weight extending perpendicularly away from the first end.

In embodiments, the rear cavity may include a rear recess. The integrated weight may fit into the rear recess fixing the adjustable weight into a first position.

In embodiments, the fastener may include threads. The opening may include grooves corresponding to the threads to allow the adjustable weight to slide along the opening.

In embodiments, the adjustable weight may include a protrusion extending toward the cover. The cover may include a recess. The protrusion may fit into the recess fixing the adjustable weight into a second position.

In accordance with some aspects of the presently disclosed technology, a golf club head may include a body portion. The body portion may include a face. The body portion may include a sole extending rearward from the face. The body portion may include a back portion positioned rearward of the face and extending from a rearward portion of the sole. The body portion may include a rear cavity formed near the sole. The golf club head may include a weight assembly. The weight assembly may include an asymmetric cover to cover the rear cavity. The asymmetric cover may include a first portion, a second portion, and a through bore. The second portion may be different from the first portion. The through bore may separate the first portion and the second portion. The weight assembly may include an adjustable weight installable underneath the asymmetric cover. The golf club head may include a fastener to engage the through bore to secure the asymmetric cover to the body portion. The fastener may engage the adjustable weight.

In embodiments, the adjustable weight may include a first end adjustably installable near the first portion. The adjustable weight may include a second end adjustably installable near a second portion. The adjustable weight may include an opening between the first end and the second end. The first end may be swivelable from near the first portion to near the second portion thereby swiveling the second end from near the second portion to near the first portion.

In embodiments, the opening may include a first end opening near the first end and a second end opening near the second end. The adjustable weight may be slidable from a first end opening to a second end opening to affect a center of gravity of the golf club head along an x-axis between about 0 mm to about 5 mm.

In embodiments, the adjustable weight may be slidable from the asymmetric cover to near a bottom of the fastener to affect a center of gravity of the golf club head along a y-axis between about 0 mm to about 15 mm.

In embodiments, the adjustable weight may include an integrated weight extending perpendicularly away from a first end of the adjustable weight.

In accordance with some aspects of the presently disclosed technology, a golf club head may include a body portion. The body portion may include a face. The body portion may include a sole extending rearward from the face. The body portion may include a back portion positioned rearward of the face and extending from a rearward portion of the sole. The body portion may include a rear cavity formed near the sole. The golf club head may include a weight assembly. The weight assembly may include a cover to cover the rear cavity. The weight assembly may include an adjustable weight. The adjustable weight may be installable underneath the cover. The adjustable weight may include an opening to allow the adjustable weight to swivel and slide into different positions. The body portion may include a fastener may engage the cover to the body portion. The fastener may engage the opening.

In embodiments, the asymmetric cover may include the first portion, the second portion, and a through bore. The through bore may separate the first portion and the second portion.

In embodiments, the first portion may be a first shape. The second portion may be a second shape that is different than the first shape.

In embodiments, the adjustable weight may include a first end adjustably installable near the first portion. The adjustable weight may include a second end adjustably installable near a second portion. The adjustable weight may include the opening between the first end and the second end. An opening length may be at least a fastener length of the fastener.

In embodiments, the cover may include a first slot along at least part of the first portion, and a second slot along at least part of the second portion. The first slot and the second slot may provide a visual indication of a position of the adjustable weight.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Before beginning the discussion on the current inventive golf club head and its performance criteria, it is worthwhile to note here that the discussion below will be based on a coordinate system 301 (shown in FIG. 3) and axis of measurement that is critical to the proper valuation of the performance numbers. Hence, it is important to recognize here that although the specific names given for the measurements below are important to the understanding of the current invention, the naming nomenclature should not be viewed in vacuum. Rather, the importance is the numbers presented below needs to be taken in context with how the coordinate system relates to the golf club head itself. In order to provide sufficient information to avoid any ambiguity, each of the figures provided below referencing a golf club head will all be accompanied by a coordinate system that is all consistent with one another.

Figure 5:
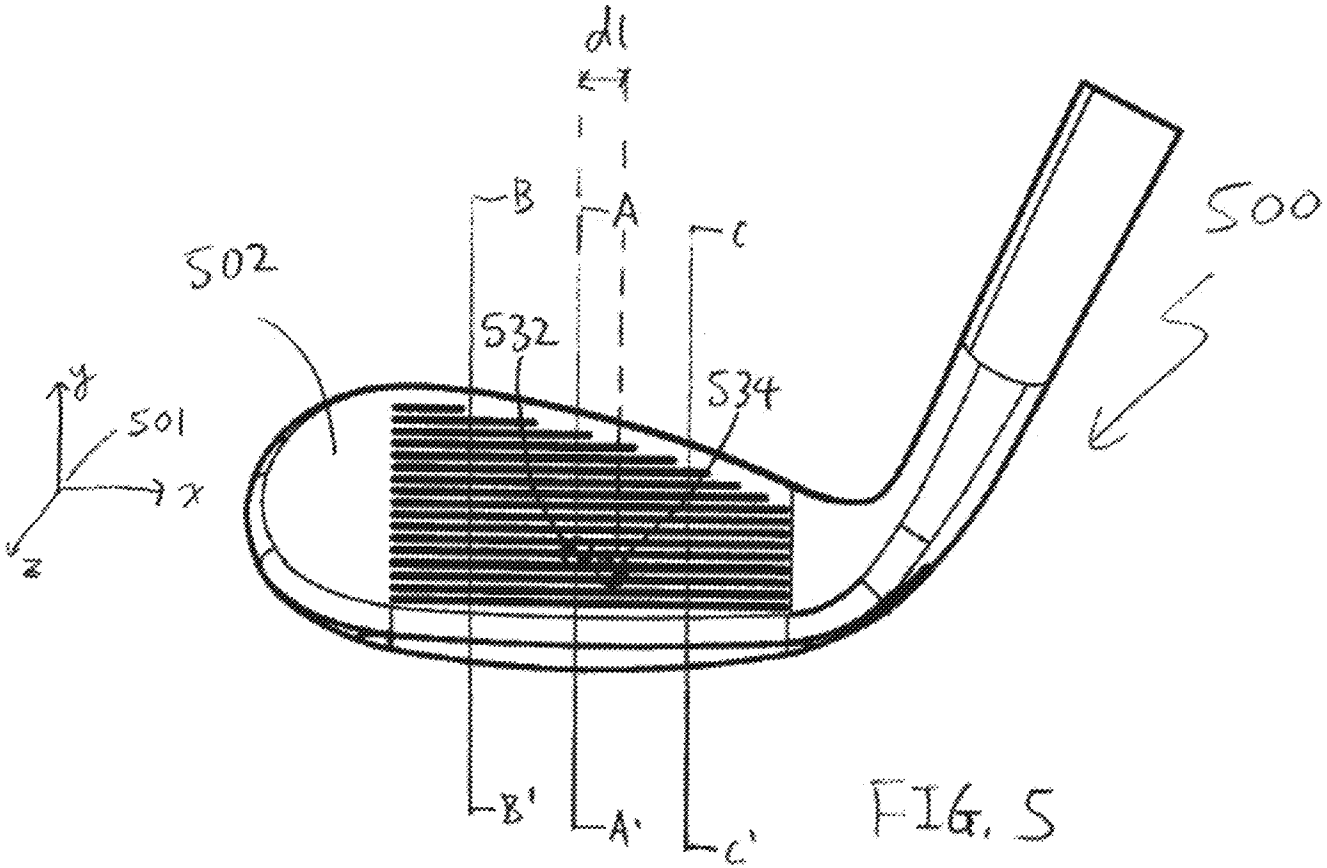
FIG. 5 of the accompanying drawings shows a frontal view of a golf club head in accordance with an embodiment of the present invention.

Pursuant to the above, and to establish the reference coordinate system for the subsequent discussion, FIG. 5 of the accompanying drawings shows the coordinate system 501 that will be used to define the various measurement and performance figures for the current invention. The x-axis used by the current discussion refers to the axis that is horizontal to the striking face from a heel to toe direction. The y-axis used by the current discussion refers to the vertical axis through the club in a crown to sole direction. The z-axis used by the current discussion refers to the horizontal axis that is horizontal front to back in a forward and rear direction. Alternatively speaking, it can be the x-axis is defined as a horizontal axis tangent to a geometric center of the striking face with the positive direction towards a heel of the golf club head, a y-axis is a vertical axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions.

Figure 1:
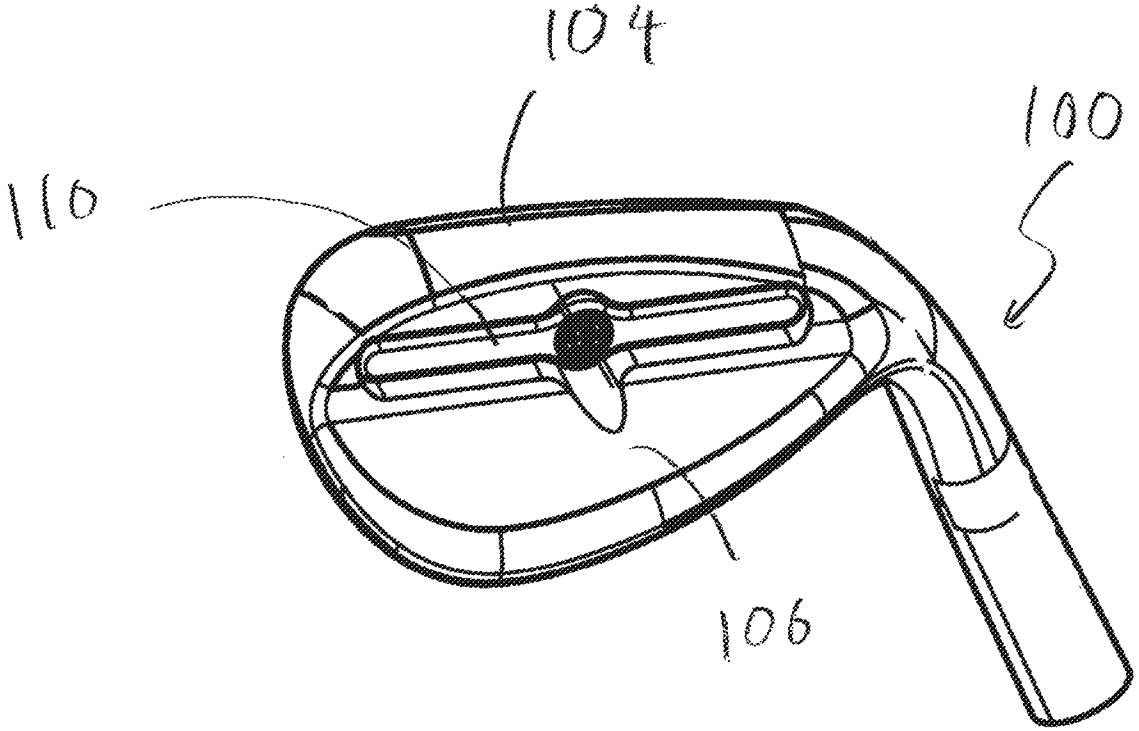
FIG. 1 of the accompanying drawings shows a perspective view of a golf club head in accordance with an embodiment of the present invention.

FIG. 1 of the accompanying drawings shows a perspective view of a golf club head 100 in accordance with an embodiment of the present invention. The golf club head 100 shown here in FIG. 1 may have a body that has a striking face 502 (shown in FIG. 5), a sole 104 extending rearward from a lower leading edge of the striking face 502 (shown in FIG. 5), and a back portion 106 positioned rearward of the striking face 502 (shown in FIG. 5) that is coupled to the rear portion of the sole 104. The golf club head 100, in accordance with this embodiment of the present invention may also have a rear cavity 208 (shown in FIG. 2) adapted to receive a weight assembly 110. The rear cavity 208 (shown in FIG. 2) is generally located within the muscle portion of the golf club head 100 to create a seamless and aesthetically pleasing visual in accordance with one of the main objectives of the present invention.

Figure 2:
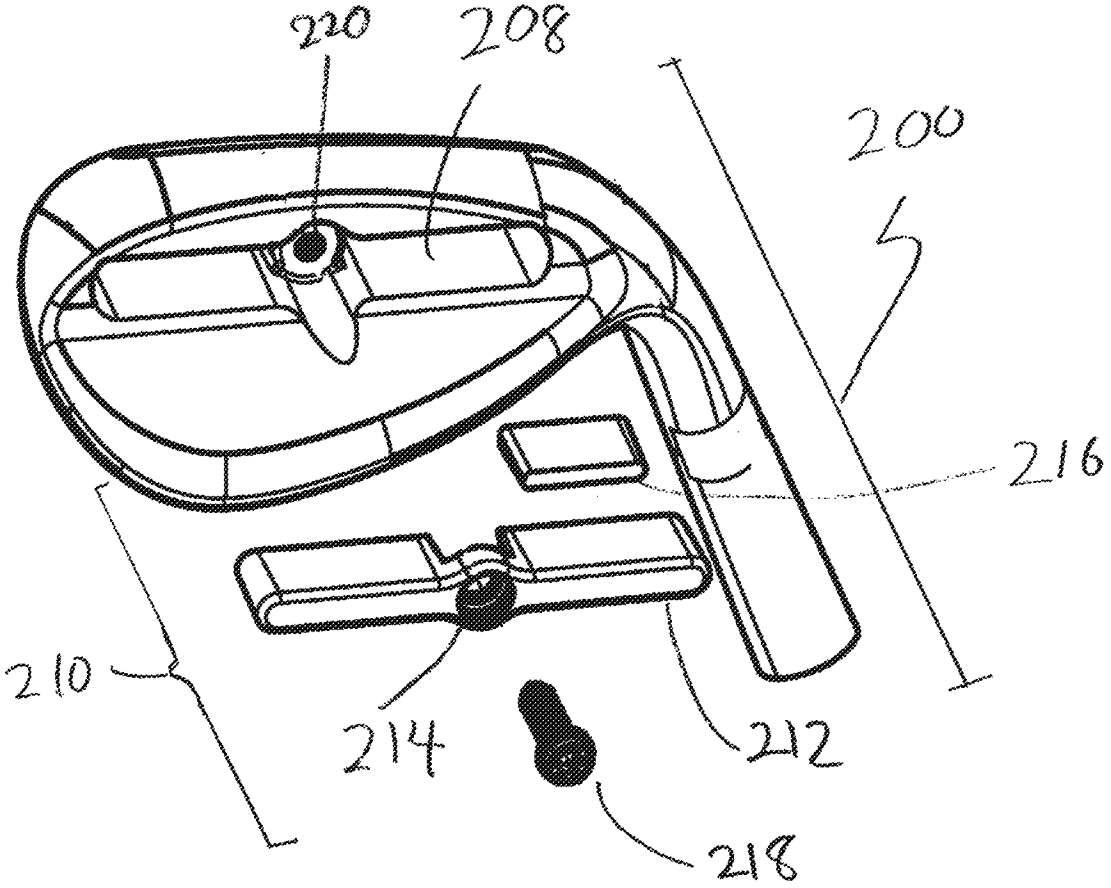
FIG. 2 of the accompanying drawings shows an exploded view of a golf club head in accordance with an embodiment of the present invention.

FIG. 2 of the accompanying drawings shows an exploded view of a golf club head 200 in accordance with an embodiment of the present invention. In this exploded view of the golf club head 200 shown in FIG. 2, with the weight assembly 210 removed from the rear cavity 208, we can see how the various components of the weight assembly 210 interface with the rear cavity 208. The weight assembly 210 shown here is further comprised out of a cover 212 that is shaped and sized to completely cover the void created by the rear cavity 208. The cover has an internal heel receptacle 322 (shown in FIG. 3) and an internal toe receptacle 324 (shown in FIG. 3), separated by a through bore 214, both of which are adapted to receive the weight 216. The fastener 218 shown in FIG. 2 allows the entirety of the weight assembly 210, including the weight 216 that is internally installed in the cover 212 is secured to the rear cavity 208 when a fastener 218 engaged a threaded receptacle 220 within the rear cavity 208.

It is worth noting here that the weight 216 may be installed into the internal heel receptacle 322 (shown in FIG. 3) or the internal toe receptacle 324 (shown in FIG. 3) to help adjust the center of gravity of the golf club head 200 depending on which receptacle its installed in. In fact, the present invention envisions that the weight 216 may not be sized to fill out the entirety of the internal heel receptacle 322 (shown in FIG. 3) or the internal toe receptacle 324 (shown in FIG. 3), further allowing for additional adjustments to the center of gravity of the golf club head 200 depending on where it is installed within each of the receptacles.

The weight 216 shown in this embodiment of the present invention may generally be made out of a high density material having a density of greater than about 12 g/cc, more preferably having a density of greater than about 14 g/cc, and most preferably having a density of greater than about 17 g/cc. In one exemplary embodiment, the preferred material for the weight 216 may be a tungsten type material, however, in alternative embodiments other various types of materials may also be used without departing from the scope and content of the present invention so long as it has a density higher than steel.

A closer comparison of the fully assembled golf club head 100 shown in FIG. 1 and the exploded view of golf club head 200 shown in FIG. 2 will illustrate one of the critical and key features of the present invention, wherein the cover 212 completely conceals the weight 216 from view when the cover 212 is fully secured to the rear cavity 208 of the golf club head 200. This feature is different from other type of tracked weighting systems where an indicator is required to identify the location, which is critical to the current wedge type design because unlike other types of golf clubs that are not subjected to heavy ground impacts, wedge type golf club heads need to be durable under impact with various turf conditions, including bunkers, making this feature critical to the present invention.

Figure 3:
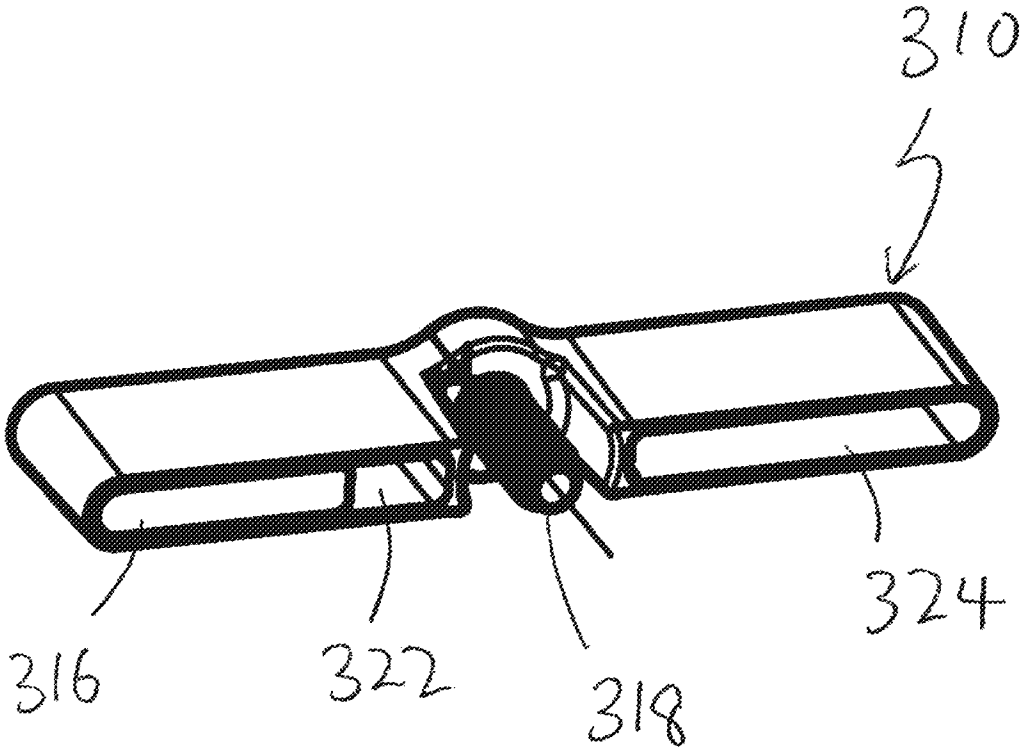
FIG. 3 of the accompanying drawings shows an internal perspective view of the weight assembly in accordance with an embodiment of the present invention.

FIG. 3 of the accompanying drawings shows an internal perspective view of the weight assembly 310 in accordance with an embodiment of the present invention. The internal perspective view of the weight assembly 310 allows the internal heel receptacle 322 and the internal toe receptacle 324 to be shown more clearly. In this embodiment of the present invention shown in FIG. 3, the weight 316 is installed in the internal heel receptacle 322, while the internal toe receptacle 324 remains empty. Having the high density weight 316 installed in the internal heel receptacle 322 will allow the center of gravity of the golf club head to be shifted towards the heel side of the golf club head, while the opposite would be true if the weight 316 is installed in the internal toe receptacle 324. Finally, FIG. 3 of the accompanying drawings also illustrates the fastener 318 separating the internal heel receptacle 322 from the internal toe receptacle 324, wherein the fastener 318 is adapted to engage the threaded receptacle 220 (shown in FIG. 2) to secure the weight assembly 310 to the golf club head.

It should be noted here that the weight 316, as shown in FIG. 3 may not completely fill up the entirety of the internal heel receptacle 322, and in this embodiment shown, only fill up the terminal side of the internal heel receptacle 322, leaving a gap in the proximal side of the internal heel receptacle 322. However, it should be noted that in alternative embodiment of the present invention, the weight 316 could occupy numerous other locations with either the internal heel receptacle 322 or the internal toe receptacle 324 all without departing from the scope and content of the present invention.

Figure 4:
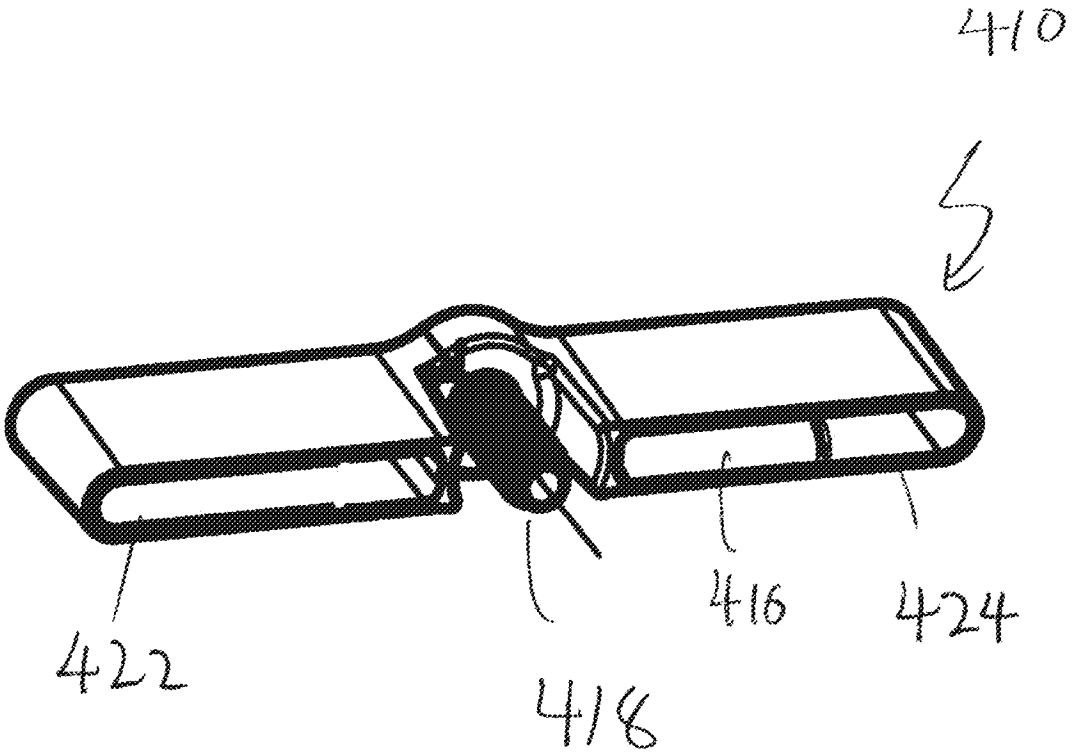
FIG. 4 of the accompany drawings shows another internal perspective view of the weight assembly in accordance with a further alternative embodiment of the present invention.

FIG. 4 of the accompany drawings shows a one of the alternative locations for the weight 416 within the internal toe receptacle 424 instead of the internal heel receptacle 422. In addition to showing an embodiment on how the weight can be placed in an alternative location within the internal toe receptacle 424, FIG. 4 of the accompanying drawings also shows that the placement of the weight within the internal toe receptacle 424 could also differ. In the weight assembly 410 shown in FIG. 4, the weight 416 can be placed closer to the fastener 418 at the proximal end of the internal toe receptacle 424, leaving a gap at the distal end of the internal toe receptacle 424. Needless to say, in a further alternative embodiment of the present invention, the weight 416 may also be placed in a proximal end of the internal heel receptacle 422 without departing from the scope and content of the present invention.

FIG. 5 of the accompanying drawings shows a frontal view of a golf club head 500, allowing the striking face 502 to be shown. In this frontal view of the golf club head 500 shown in FIG. 5, we can identify cross-sectional lines A-A', B-B', and C-C', the details of which will be shown later. The cross-sectional line A-A' passes through the center of the fastener 218 (shown in FIG. 2), the cross-sectional line B-B' passes through a plane toeward of cross-sectional line A-A', and can illustrate the empty side of the internal toe receptacle, which in this embodiment, is shown as the empty cavity.

In addition to illustrating the cross-sectional lines along this x-y plane, FIG. 5 of the accompanying drawings also shows a face center 532 and a center of gravity 534 location of the golf club head 500. The face center 532 of the golf club head 500 is defined as the midpoint between the full length scorelines (ignoring any partial scorelines at the top of the striking face 502) along the x-axis, located on frontal striking surface of the striking face 502 on the fifth scoreline counting from the bottom. Highlighting the location of the center of gravity in the present invention is important because the adjustable weight assembly 210 (shown in FIG. 2) adjusts the location of the weight along the x-axis, thus the resultant center of gravity location along the x-axis will change depending on the location of the weight 216 (shown in FIG. 2) within the weight assembly 210 (shown in FIG. 2).

In this current embodiment of the present invention, the distance d1 of the center of gravity 534 along the x-axis away from the face center 532 may generally be between about 2 mm to about 8 mm, more preferably between about 3 mm to about 7 mm, and most preferably between about 3 mm to about 6 mm. Because the range of center of gravity locations above relate to different wedge chassis having different lofts, the entirety of the CG distance range articulated above is generally not within the possibility of the adjustability. In reality, the change in center of gravity location of the wedge between the extremities of the weight placement within the internal heel receptacle 322 (shown in FIG. 3) and the internal toe receptacle 324 (shown in FIG. 3) of the weight assembly 310 (shown in FIG. 3) may result in a delta change, quantified as Ax of between about 0 mm to about 2.5 mm, more preferably between about 0 mm to about 2.0 mm, and most preferably between 0 mm and about 1.8 mm, all without departing from the scope and content of the present invention. Alternatively speaking, it can be said that the weigh assembly 310 is capable of achieving a delta change along the x-axis (Ax) of between about 0 mm to about 2.5 mm, more preferably between about 0 mm to about 2.0 mm, and most preferably between 0 mm and about 1.8 mm.

Figure 6:
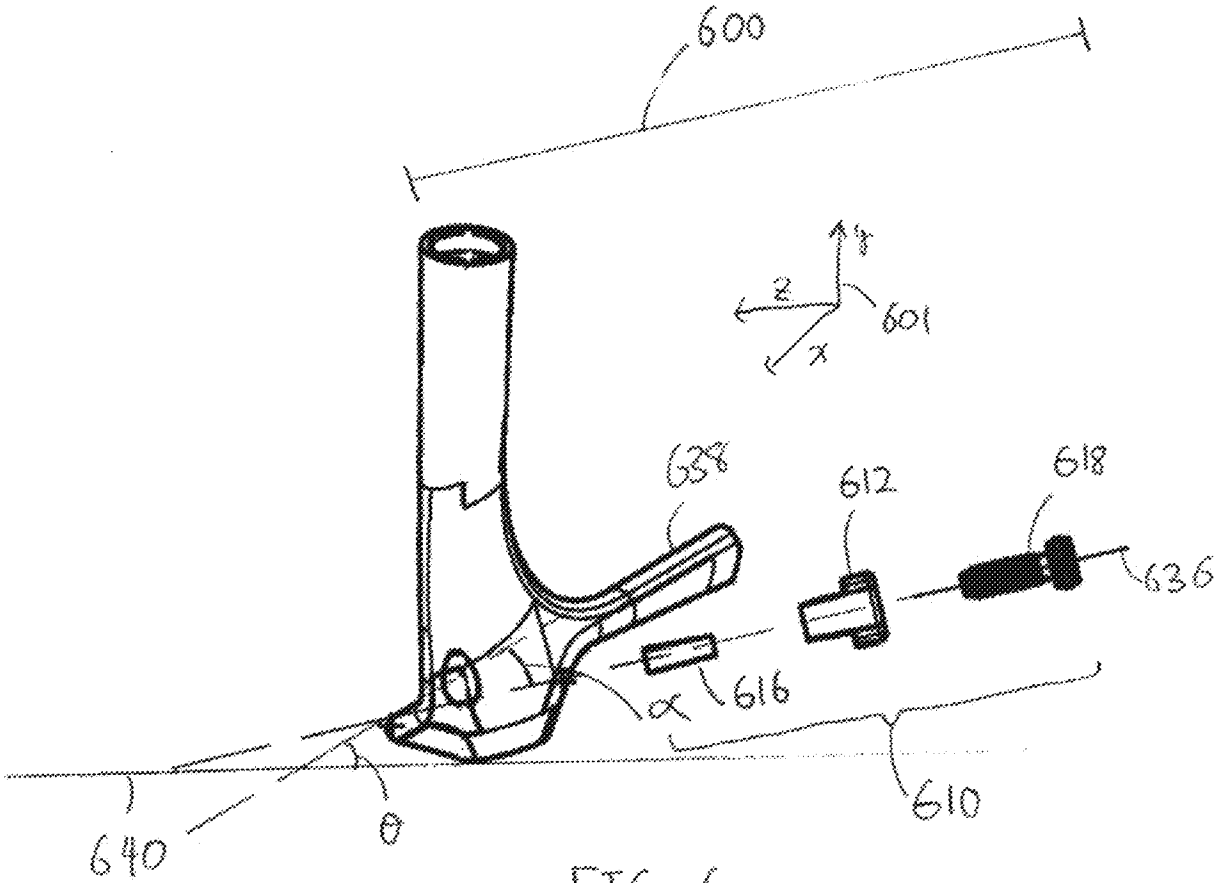
FIG. 6 of the accompanying drawings shows an exploded heel side view of a golf club head in accordance with an embodiment of the present invention.

FIG. 6 of the accompanying drawings shows an exploded heel side view of a golf club head 600 in accordance with an embodiment of the present invention. In this exploded view of the golf club head 600, it can be seen that the entirely of weight assembly 610 moves along a weight axis 636, which forms a weight assembly angle α with the loft plane 638 of the golf club head 600. The loft plane 638 shown here in FIG. 6 is a plane that is formed along x-z plane as shown in the coordinate system 601 and is intended to capture the loft of the golf club head 600. The loft plane 638 form a loft angle θ with the ground plane 640 that is greater than about 40 degrees, more preferably greater than about 43 degrees, and most preferably greater than about 45 degrees.

The weight assembly angle α is critical to the present invention because it ensures that the weight assembly 610 is strategically placed within the muscle portion of the golf club head 600. In the current exemplary embodiment of the present invention, the weight assembly angle α may generally be between −10 degrees and +10 degrees of the loft plane 638, more preferably between −5 degrees and +10 degrees of the loft plane 638, and most preferably between about 0 degrees and +10 degrees of the loft plane 638. In the embodiment shown in FIG. 6, the weight assembly angle α may be illustrated as a positive number, but a could also be a negative number as described above without departing from the scope and content of the present invention.

In addition to illustrating the two angles above, the exploded heel side view of the golf club head 600 also allows the cover 612, the weight 616, and the fastener 618 of the weight assembly 610 to be shown in more detail. In this specific embodiment of the present invention, the fastener 318 may be a double threaded screw that allows for ease of partial extraction to facilitate the flipping of the cover 612 of the weight assembly 610 also without departing from the scope and content of the present invention. In this embodiment of the present invention, the coarse thread portion of the double threaded fastener 618 may form the first 4 mm portion of the thread, allowing the first 4 mm of the disengagement process to occur quickly, while the remaining portion of the threads have a finer composition to prevent accidental removal of the entire cover 612 without departing from the scope and content of the present invention.

Figure 7:
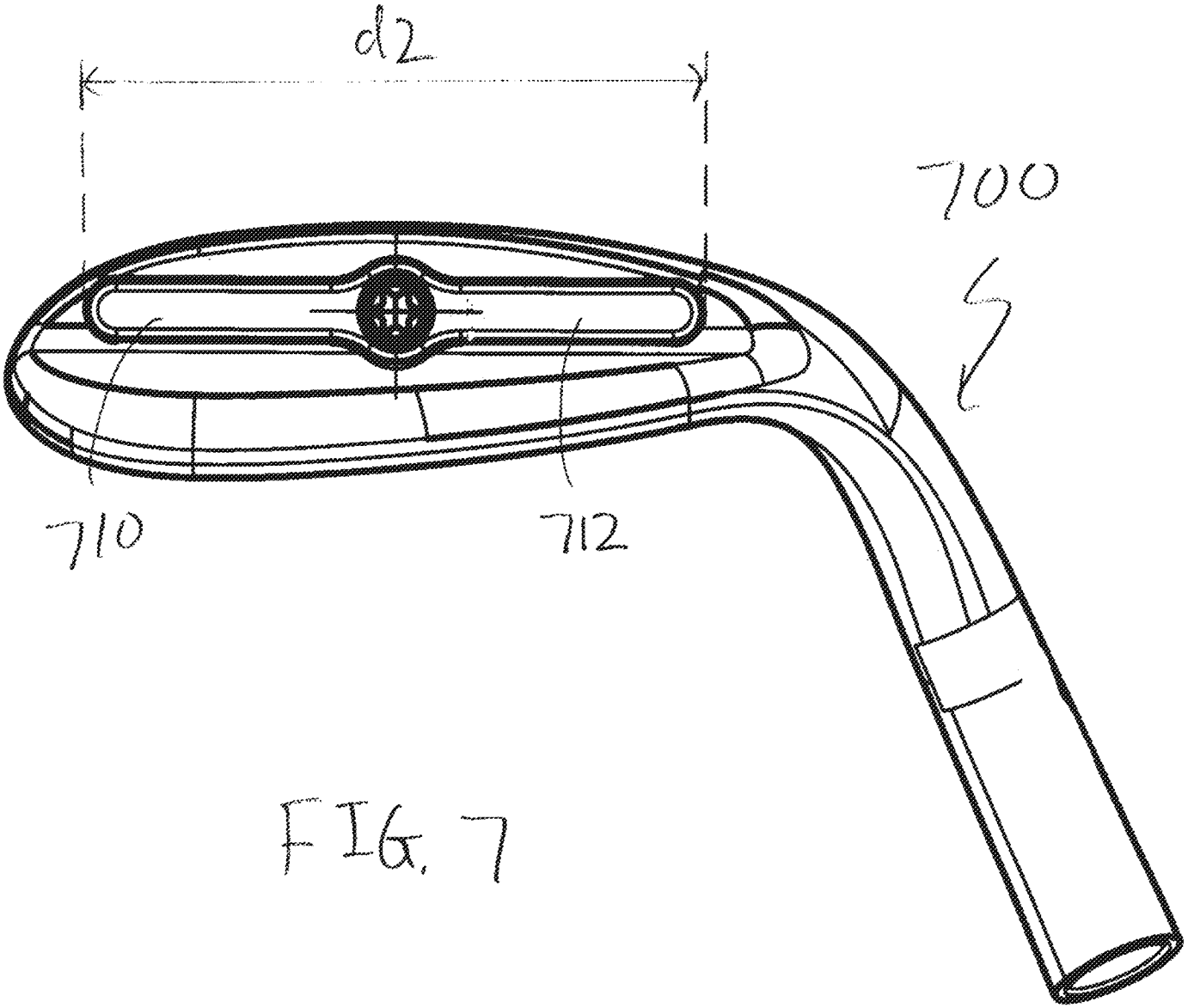
FIG. 7 of the accompanying drawings shows a rear view of a golf club head in accordance with an embodiment of the present invention.

FIG. 7 of the accompanying drawings shows a rear view of a golf club head 700 in accordance with an embodiment of the present invention. In this view of the invention shown in FIG. 7, it can be seen once again that when fully installed, the cover 712 of the weight assembly 710 is sized and shaped to have the same size and dimension as the rear cavity 208 (shown in FIG. 2) thus that in this rear view, the rear cavity 208 (shown in FIG. 2) is completely concealed. Moreover, as previously mentioned, the critical aspect of the present invention shown in FIG. 7 is that the weight that is inserted within either the internal heel receptacle or the internal toe receptacle is completely hidden and invisible from this view, which as previously discussed, is a critical aspect of the present invention.

In addition to reinforcing this key feature of the present invention, FIG. 7 of the accompanying drawings shows a weight assembly 710 width d2 that is measured from the heel most point of the weight assembly 710 to the toe most point of the weight assembly 710. Width d2, as shown in this embodiment of the present invention, may generally be greater than about 45 mm, more preferably greater than about 50 mm, and most preferably greater than about 55 mm, all without departing from the scope and content of the present invention.

Figure 8:
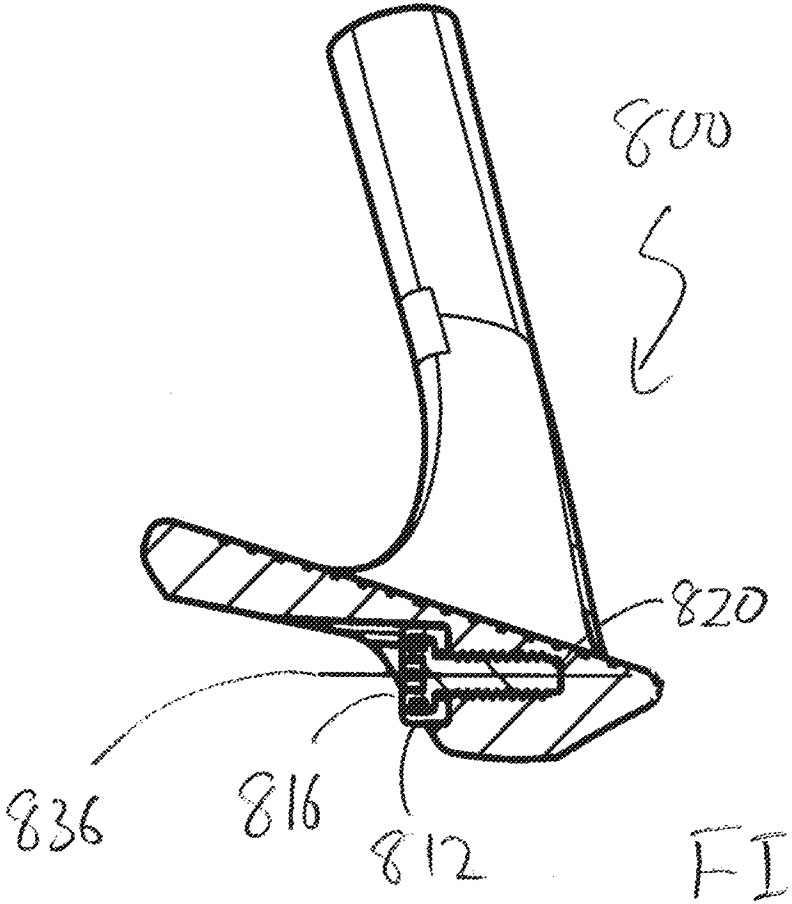
FIG. 8 of the accompanying drawings shows a cross-sectional view of a golf club head taken along cross-sectional line A-A' shown in FIG. 5, in accordance with an embodiment of the present invention.

FIG. 8 of the accompanying drawings shows a cross-sectional view of a golf club head 800 taken along cross-sectional line A-A' shown in FIG. 5, down the middle of the club head where the fastener 816 is located. This cross-sectional view of the golf club head 800 taken along cross-sectional line A-A' illustrates the how the internal components of the fastener 812 can be used to secure the cover 810 into a threaded receptacle 820 of the rear cavity along the weight axis 836.

Figure 9:
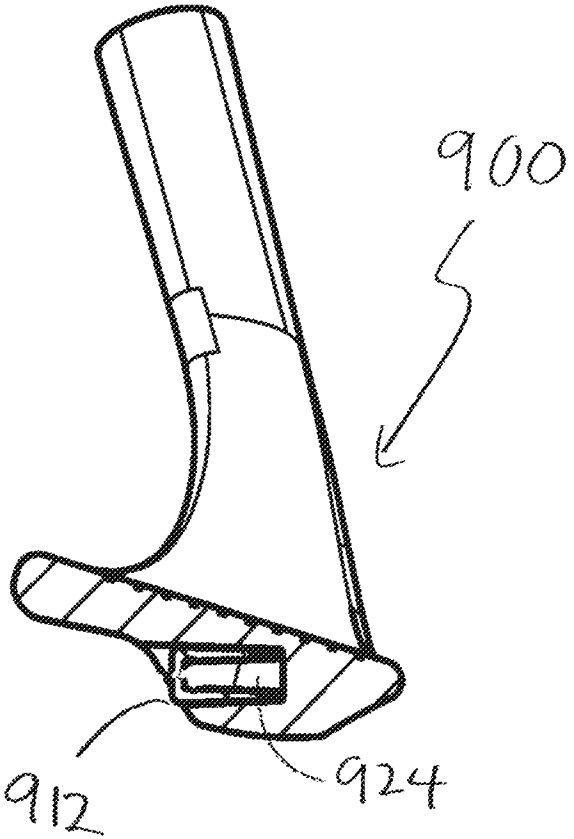
FIG. 9 of the accompanying drawings shows a cross-sectional view of a golf club head taken along cross-sectional line B-B' shown in FIG. 5, in accordance with an embodiment of the present invention.

FIG. 9 of the accompanying drawings shows a cross-sectional view of a golf club head 900 taken along cross-sectional line B-B' shown in FIG. 5, at a location that bisects the internal toe receptacle 924. This cross-sectional view of the golf club head 900 taken along cross-sectional line B-B' illustrates the internal component of the cover 912 concealing the rear cavity, wherein the internal toe receptacle 924 does not contain any weight.

Figure 10:
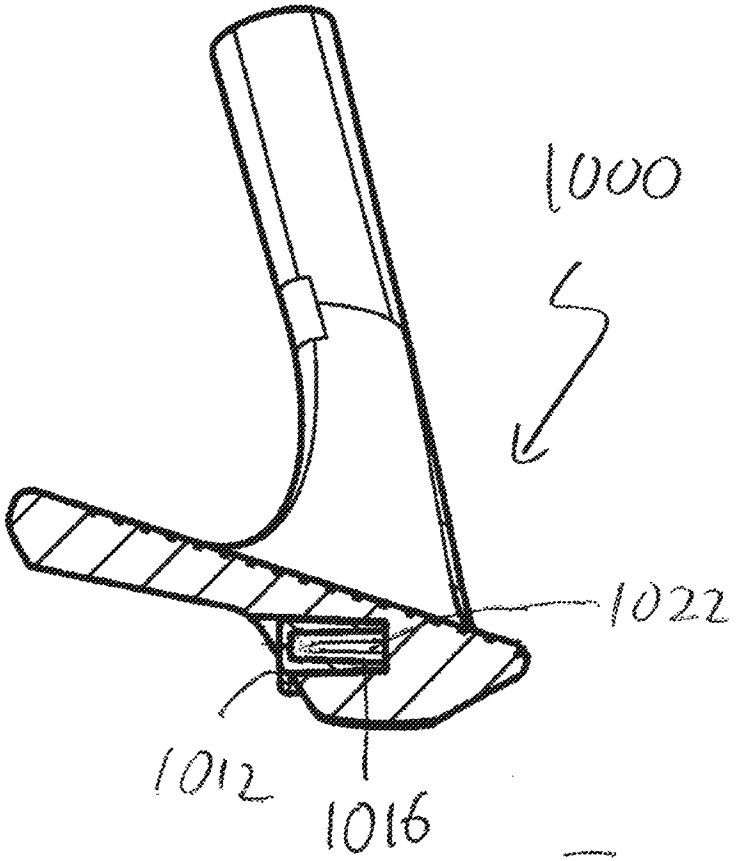
FIG. 10 of the accompanying drawings shows a cross-sectional view of a golf club head taken along cross-sectional line C-C' shown in FIG. 5, in accordance with an embodiment of the present invention.

FIG. 10 of the accompanying drawings shows a cross-sectional view of a golf club head 1000 taken along cross-sectional line C-C' shown in FIG. 5, at a location that bisects the internal heel receptacle 1022. This cross-sectional view of the golf club head 1000 taken along cross-sectional line C-C' illustrates the internal components of the cover 1012 concealing the rear cavity, wherein the internal heel receptacle 1022 does contain a weight 1016.

Figure 11:
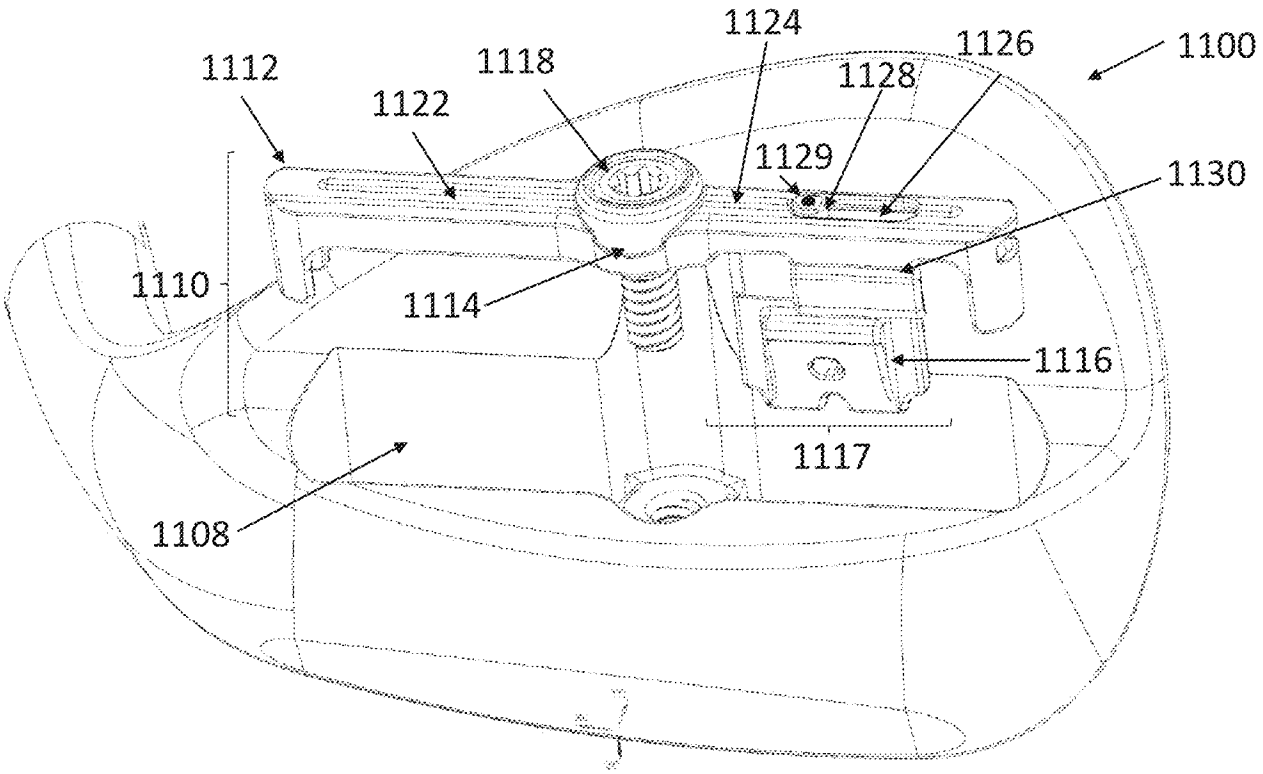
FIG. 11 of the accompanying drawings shows an exploded perspective view of a golf club head in accordance with an embodiment of the present invention.

FIG. 11 of the accompanying drawings shows an exploded perspective view of a golf club head 1100 in accordance with an embodiment of the present invention. In this perspective view of golf club head 1100, weight assembly 1110 is in an unfastened state, that is, where weight assembly 1110 is removed from rear cavity 1108. In the unfastened state, it may be easier to see how the various components of weight assembly 1110 interface with rear cavity 1108. Weight assembly 1110 may include cover 1112 that is shaped and sized to cover the void created by rear cavity 1108 and weight 1116, which includes weight body 1117 and protrusion 1128. In embodiments, weight 1116 may be referred to as a movable weight or a detachable weight to indicate it can slide along an opening (e.g., toe opening 1126 or heel opening (not shown in FIG. 11)) and/or can be detachable from a first opening (e.g., toe opening 1126 or heel opening (not shown in FIG. 11)) and removably attachable to a second opening (e.g., heel opening (not shown in FIG. 11) or toe opening 1126) without departing from the spirit and scope of the presently disclosed technology as set forth in the claims. Cover 1112 may include heel portion 1122 and toe portion 1124, separated by through bore 1114 and fastener 1118. Cover 1112 may also include toe opening 1126. Heel portion 1122 and toe portion 1124 may be adapted to receive weight 1116. As illustrated, heel portion 1122 and toe portion 1124 have less material on at least the side walls than embodiments of the internal heel receptacles and the internal toe receptacles described herein. For example, material on sides of cover 1112, between a heel end, the end furthest from through bore 1114, of heel portion 1122 and a toe end, the end furthest from through bore 1114, of toe portion 1124, may be different from sides of embodiments disclosing the internal heel receptacles and the internal toe receptacles described herein. However, it should be appreciated that heel portion 1122 and toe portion 1124 may be designed differently in different embodiments, including, for example, with no material along a side of heel portion 1122, no material along a heel end of heel portion 1122, no material along an end or sides of toe portion 1124, a gradual increase, or taper, in material from through bore 1114 toward toe end of toe portion 1124, a gradual decrease in material from through bore 1114 toward toe end of toe portion 1124, a different shape and/or size adapted to fit in rear cavity 1108, and/or other types of covers without departing from the spirit and scope of the presently disclosed technology as set forth in the claims.

Figure 12:
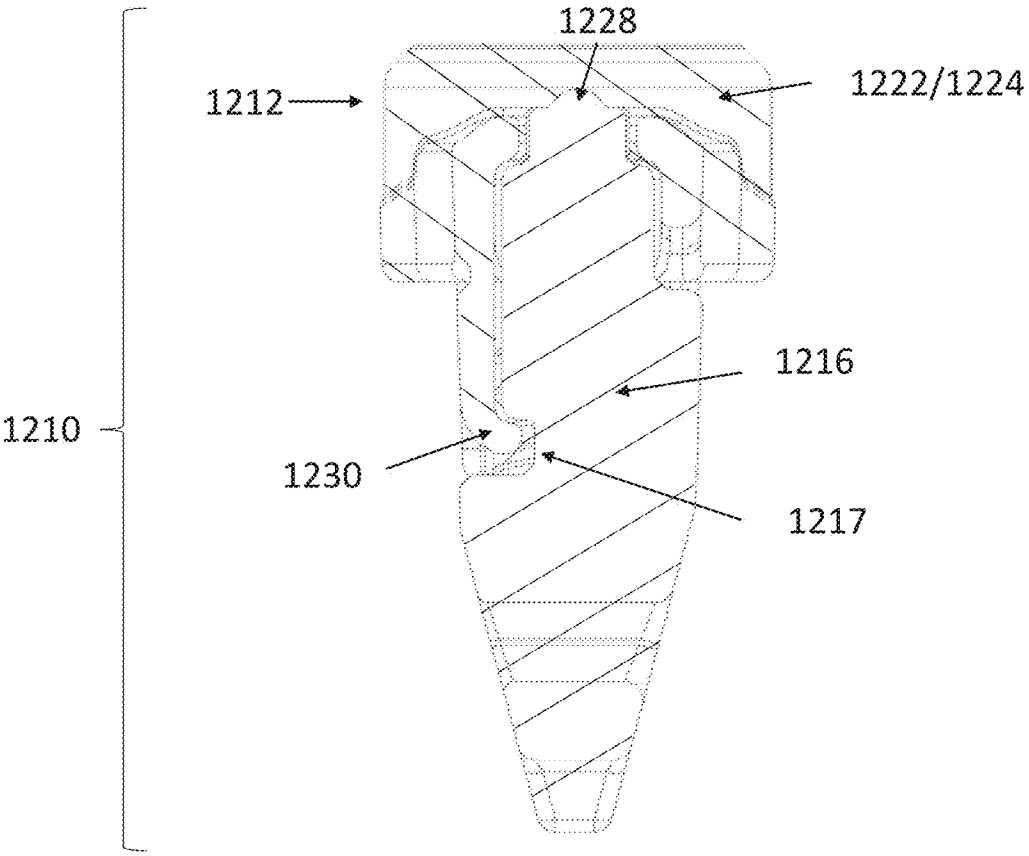
FIG. 12 of the accompanying drawings shows a cross-sectional view of the weight assembly in accordance with an embodiment of the present invention.

In embodiments, securing element 1130 of toe portion 1124 may be used to secure weight 1116 to cover 1112. For example, FIG. 12 illustrates a cross-sectional view of the weight assembly in accordance with an embodiment of the present invention. Weight assembly 1210 may be the same as or substantially similar to weight assembly 1110. As illustrated, a lower portion of securing element 1230 is adapted to fit within groove 1217 of weight 1216. As discussed herein, weight 1216 may be installed in heel portion 1222 or toe portion 1224. It should be appreciated this is one mechanism to install weight 1216 to cover 1212, and there may be other ways of installing weight 1116, including for example, another mechanism may include an adjustable heel portion or adjustable toe portion that loosens and tightens across the cross-section illustrated in FIG. 12 to install weight 1216 to cover 1212, pressure fitting weight 1216 into heel portion 1222 or toe portion 1224, a groove in weight 1216 between weight body and a top surface of protrusion 1228 to fit into toe opening 1126 or a heel opening, and/or other mechanisms without departing from the spirit and scope of the presently disclosed technology as set forth in the claims. In some embodiments, a length of the weight body may be greater than a length of at least one of the heel opening or toe opening 1126. In embodiments, a length of the weight body may be smaller than a length of at least one of the heel opening or toe opening 1126.

Referring back to FIG. 11, weight 1116 may be installed within toe portion 1124 at a location closest to through bore 1114. It should be appreciated that weight 1116 may be moved anywhere along toe opening 1126 toward a toe end of toe portion 1124. In some embodiments, weight 1116 may be installed along heel portion 1122 where a heel opening (not shown in FIG. 11) may be. In embodiments, protrusion 1128 may be detachable to allow a user to detach weight 1116 from a toe portion 1124 to heel portion 1122 in an embodiment of cover 1112 with toe opening 1126 and heel opening (not shown in FIG. 11). In some embodiments, weight 1116 may be pre-installed into toe opening 1126 or heel opening (not shown in FIG. 11). It should also be appreciated that a length of toe opening 1126 or heel opening (not shown in FIG. 11) may be longer or shorter than what is illustrated. The position of weight 1116 along cover 1112 may be used to help adjust the center of gravity of the golf club head 1100.

Protrusion 1128 may include visual indicator 1129, in a first color, on a top surface of protrusion 1128. In embodiments, visual indicator 1129 may cover a portion of the top surface of protrusion 1128. In some embodiments, visual indicator 1129 may cover the entire top surface of protrusion 1128. In some embodiments, protrusion 1128 may be the visual indicator 1129. While visual indicator 1129 is illustrated as a circular dot, it should be appreciated that visual indicator 1129 may take different forms, including for example, a star-shaped dimple, a hexagonal bump, a painted triangle, a forged line, a movable square visual indicator, and other types of visual indicators. A position of movable weight 1116 along cover 1112 may be indicated by visual indicator 1129 that is viewable through toe opening 1126.

Figure 13:
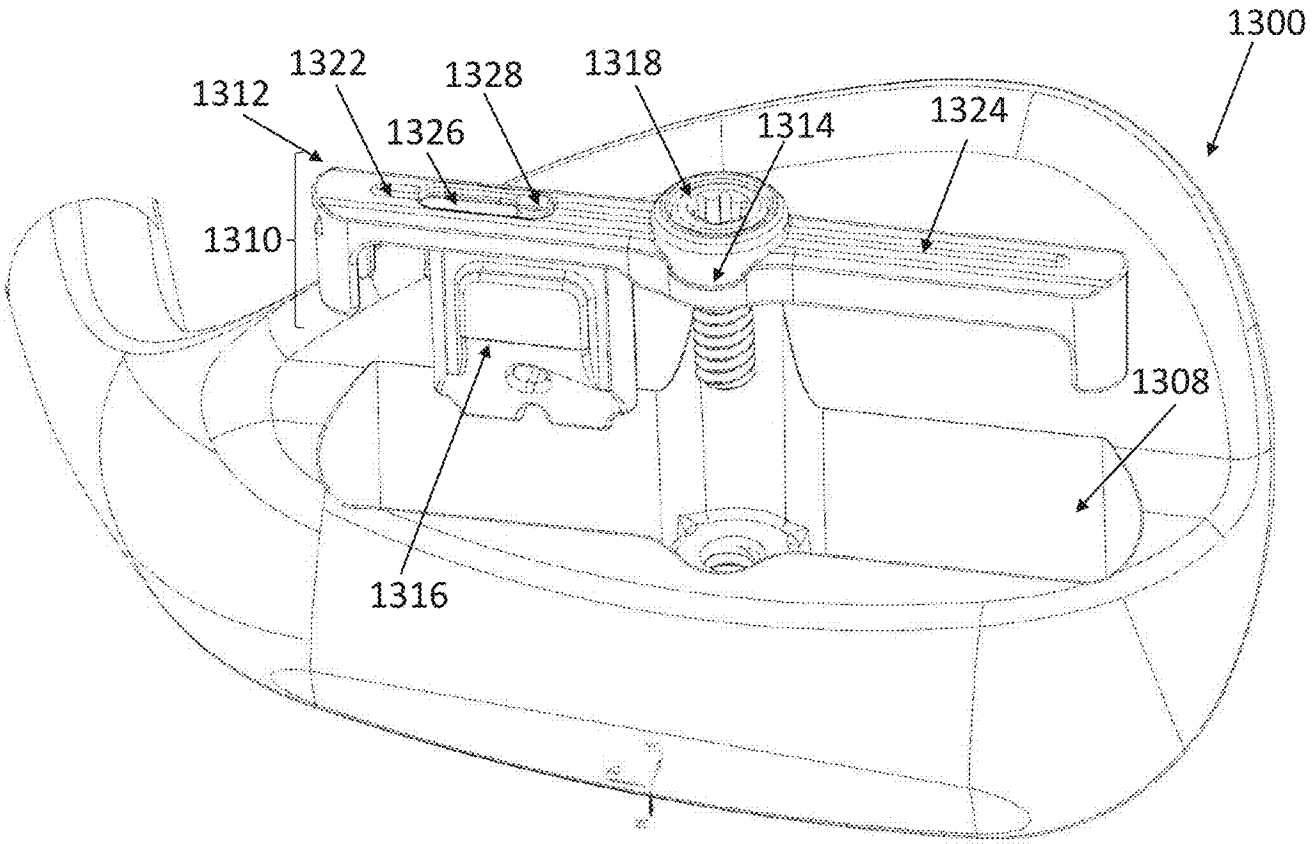
FIG. 13 of the accompanying drawings shows an exploded perspective view of a golf club head in accordance with an embodiment of the present invention.

FIG. 13 of the accompanying drawings shows an exploded perspective view of a golf club head 1300 in accordance with an embodiment of the present invention. FIG. 13 illustrates components that may be the same or substantially similar to components illustrated in FIG. 11. For example, golf club head 1300 may be the same as or substantially similar to weight golf club head 1100, weight 1316 may be the same as or substantially similar to weight 1116, rear cavity 1308 may be the same as or substantially similar to rear cavity 1108, and weight assembly may be in an unfastened state. Heel portion 1322 may include heel opening 1326 to view protrusion 1328. Heel portion 1322 may be separated by toe portion 1324 by through bore 1314 and fastener 1318.

Figure 14:
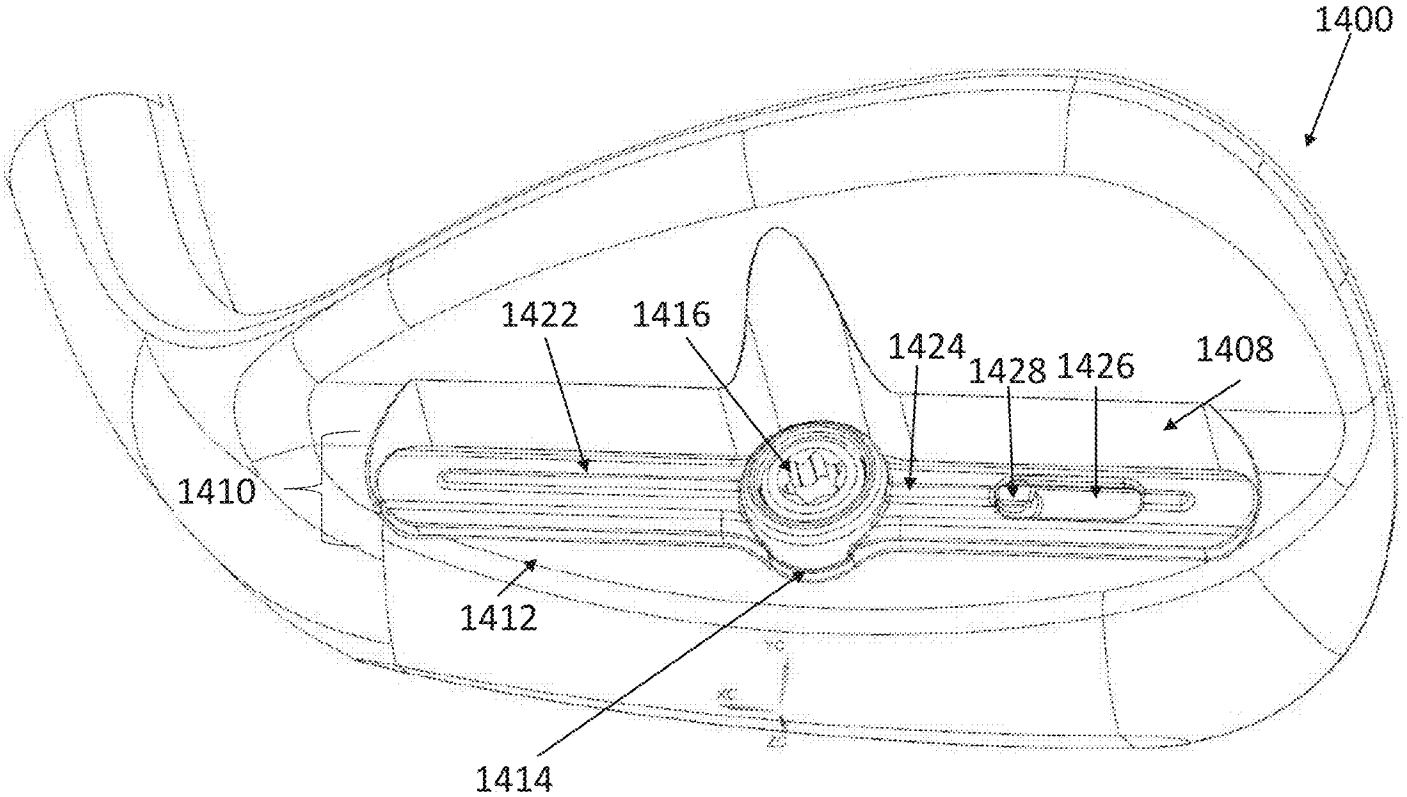
FIG. 14 of the accompanying drawings shows a perspective view of a golf club head in accordance with an embodiment of the present invention.

FIG. 14 of the accompanying drawings shows a perspective view of a golf club head 1400 in accordance with an embodiment of the present invention. FIG. 14 illustrates components that may be the same or substantially similar to components illustrated in FIG. 11. For example, golf club head 1400 may be the same as or substantially similar to golf club head 1100, cover 1412 may be the same as or substantially similar to cover 1112, and rear cavity 1408 may be the same as or substantially similar to rear cavity 1108. As illustrated, weight assembly 1410 may be in a fastened state, that is, where weight assembly 1110 is fastened to rear cavity 1408.

Figure 15:
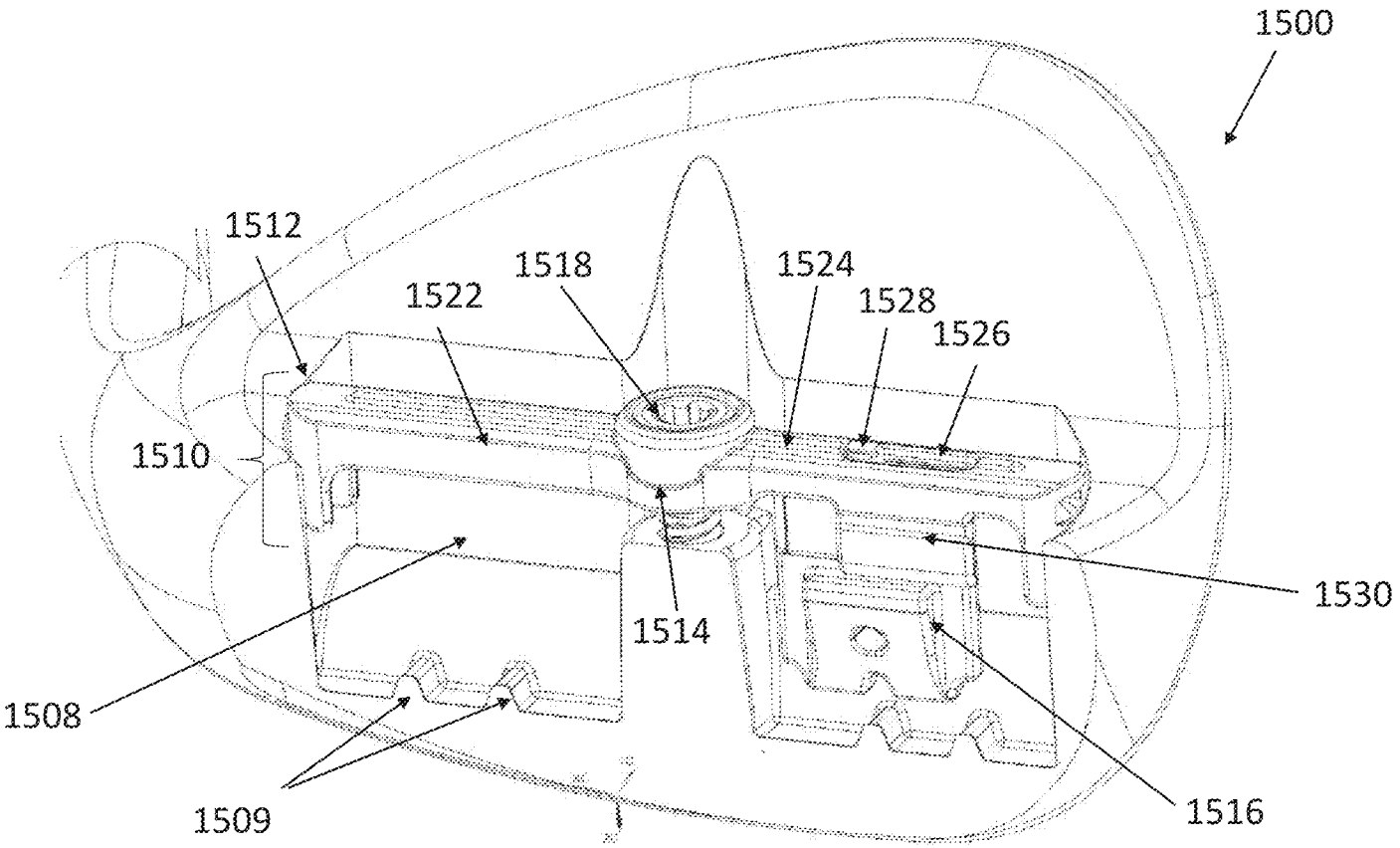
FIG. 15 of the accompanying drawings shows a partially cut open perspective view of a golf club head in accordance with an embodiment of the present invention.

FIG. 15 of the accompanying drawings shows a partially cut open perspective view of a golf club head 1500 in accordance with an embodiment of the present invention. FIG. 15 illustrates components that may be the same or substantially similar to components illustrated in FIG. 11. For example, golf club head 1500 may be the same as or substantially similar to golf club head 1100, cover 1512 may be the same as or substantially similar to cover 1112, and rear cavity 1508 may be the same as or substantially similar to rear cavity 1108. As illustrated in this cut away perspective view, rear cavity 1508 may include positional elements 1509 adapted to engage weight 1516. For example, positional elements 1509 may be shaped and sized to engage a bottom surface of weight 1516. It should be appreciated that the number of positional elements 1509 may be less than two or more than two. It should be appreciated that rear cavity 1508 may not have any positional elements 1509, and weight 1516 may be continually adjustable along toe opening 1526. In embodiments, weight 1516 may be secured in a position with another mechanism, including, for example, a cover fastener with another through bore on cover 1512 and a threaded portion on weight 1516, an adjustable cover as described above, a protrusion fastener where protrusion 1528 is adapted to be removably secured to weight 1516, a click-to-secure mechanism with positional elements on cover 1512 and weight 1516, a snap-on mechanism with one or more through bores on cover 1512 engaging with protrusion 1528, and/or other mechanisms without departing from the spirit and scope of the presently disclosed technology as set forth in the claims. A position of weight 1516 along cover 1512 may be indicated by protrusion 1528 and/or a visual indicator (not shown in FIG. 15).

Figure 16:
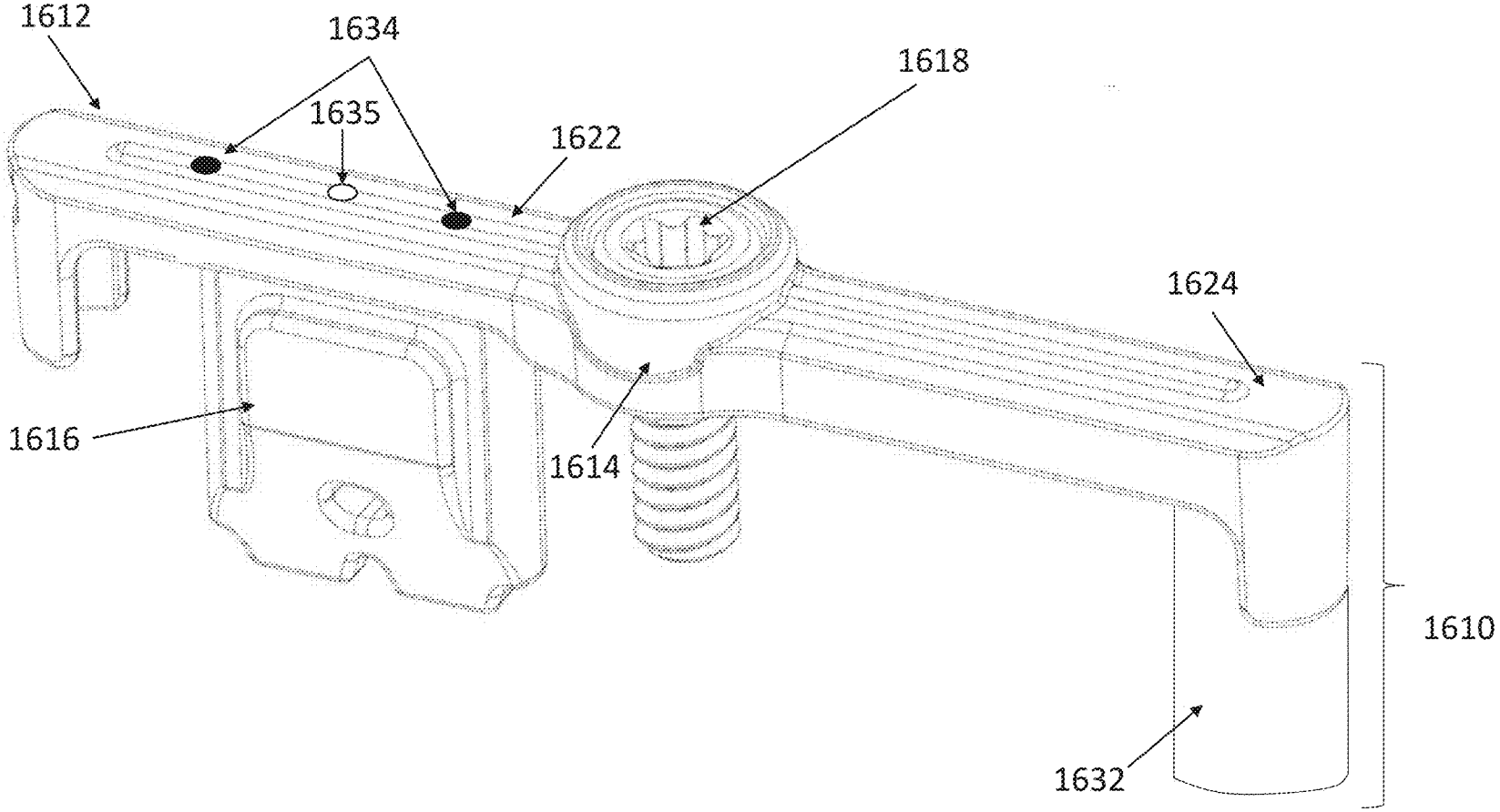
FIG. 16 of the accompanying drawings shows a perspective view of the weight assembly in accordance with an embodiment of the present invention.

FIG. 16 of the accompanying drawings shows a perspective view of the weight assembly 1610 in accordance with an embodiment of the present invention. FIG. 16 illustrates components that may be the same or substantially similar to components illustrated in FIG. 13. Weight assembly 1610 may include biased weight 1632 and multiple visual indicators 1634, 1635. As illustrated, biased weight 1632 may be an integrated weight. The integrated weight may extend from a toe end of toe portion 1624. It should be appreciated that in some embodiments biased weight 1632 may use different materials or composites in cover 1612 to make toe portion 1624 heavier than heel portion, or vice versa, without the use of an integrated-type weight that extends from a toe edge of toe portion 1624 without departing from the spirit and scope of the presently disclosed technology as set forth in the claims. It should also be appreciated that the shape and/or size of weight 1632 may differ without departing from the spirit and scope of the presently disclosed technology as set forth in the claims.

Visual indicator 1635 may be a second color to indicate a current position of weight 1616. In some embodiments, movable weight 1616 may be movable to a neutral position on an opposite side of biased weight 1632 to provide a neutral center of gravity for a golf club head. A neutral center of gravity may be the center of gravity without weight 1616 and biased weight 1632 or the center of gravity without weight assembly 1610. The neutral position may be the position of weight 1616 to provide the neutral center of gravity for the golf club head with weight assembly 1610 installed. In some embodiments, moving the movable weight along at least one of the heel opening or the toe opening is capable of a delta change in center of gravity along an x-axis (Ax) between about 0 mm to about 2 mm. In embodiments, moving movable weight 1616 may cause a delta change in center of gravity along an x-axis (Ax) between about 0 mm to about 1 mm. In some embodiments, moving movable weight 1616 may cause a delta change in center of gravity along an x-axis (Ax) between about 0 mm to about 0.5 mm. The actual distance moved by weight 1616 along toe portion or heel portion may be up to 10 mm, 8 mm, 6 mm, 4 mm, and so on, including any values in between without departing from the spirit and scope of the presently disclosed technology as set forth in the claims.

In embodiments, visual indicators 1634, 1635 may include a magnetically activated paint such that the presence of a magnetic field of a given strength reversibly changes the color of visual indicators 1634, 1635. The magnetic field may be greater than 0.005 Teslas, 0.01 Teslas, 0.02 Teslas, or the like, including any values in between, It should be appreciated that these magnetic field values are merely examples and other values may be used to trigger the reversible color change of visual indicators 1634, 1635 without departing from the spirit and scope of the presently disclosed technology as set forth in the claims. In some embodiments, weight 1616 may be magnetic. As illustrated, visual indicator 1635 is a second color because weight 1616 is at or within a spatial proximity to visual indicator 1635 such that it triggers a reversible color change of visual indicator 1635. Visual indicators 1634 may be outside the spatial proximity of the magnetic field of movable magnetic weight 1616 such that visual indicators are a first color. In some embodiments, cover 1612 may be translucent on at least a top surface and visual indicator (not shown in FIG. 16) may be visible through cover 1612 to indicate a position of weight 1616. In embodiments, cover 1612 may be transparent on at least a top surface. In embodiments, weight assembly 1610 may include a clip (not shown) to secure fastener 1618 to cover 1612 in an unfastened state. The clip may be permanent or removable. The clip may prevent loss of fastener 1618 when fastener 1618 is unfastened from cover 1612.

Figure 17:
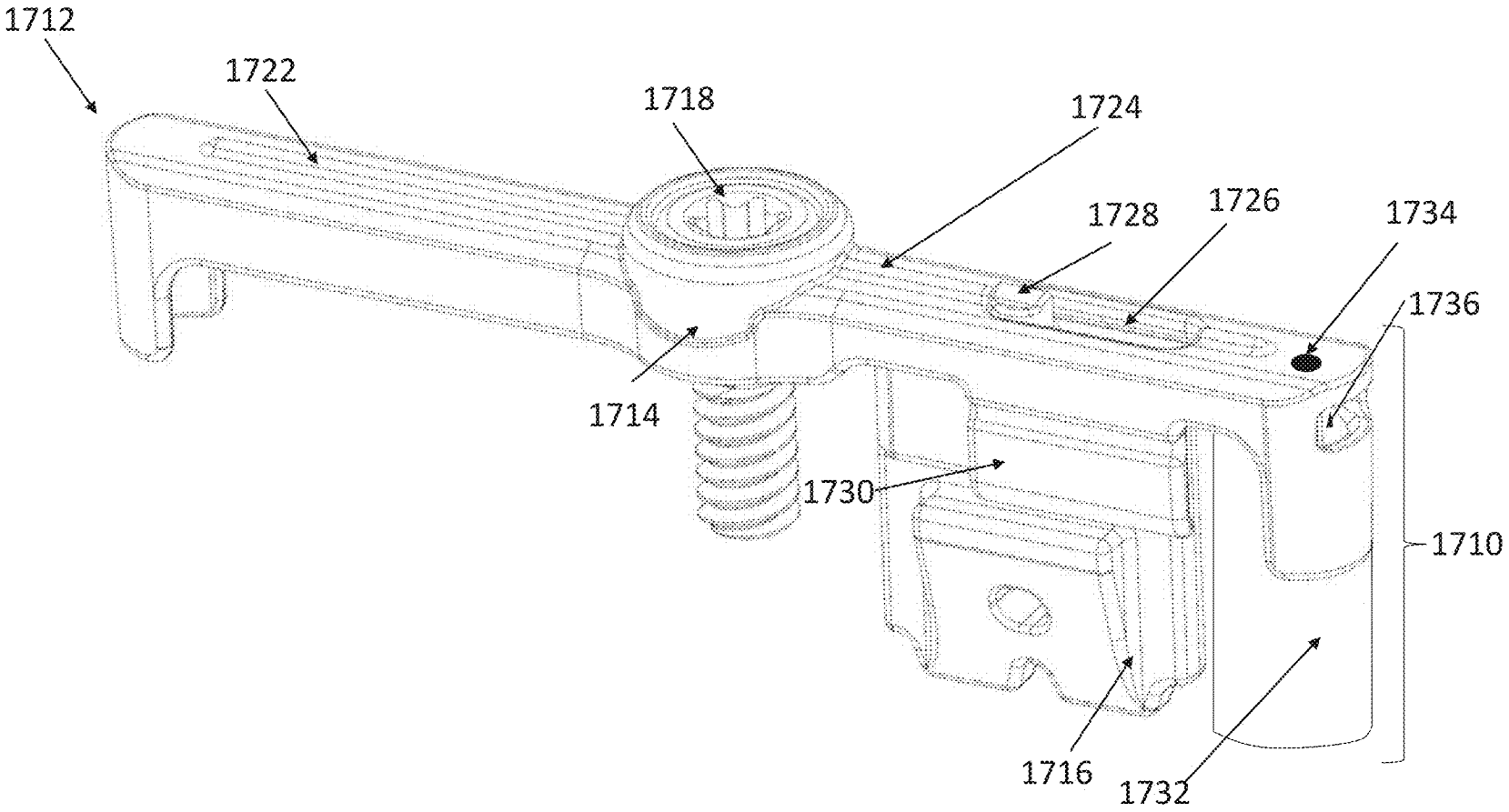
FIG. 17 of the accompanying drawings shows a perspective view of the weight assembly in accordance with an embodiment of the present invention.

FIG. 17 of the accompanying drawings shows a perspective view of the weight assembly 1710 in accordance with an embodiment of the present invention. FIG. 17 illustrates components that may be the same or substantially similar to components illustrated in FIG. 16. Weight assembly 1710 may include visual indicator 1734 and window 1736. Visual indicator 1734 and/or window 1736 may be used to indicate whether the biased weight is biased toward the heel portion or biased toward the toe portion. While visual indicator 1734 is illustrated as being positioned on a toe end of toe portion 1724, it should be appreciated that visual indicator 1734 may be positioned anywhere along toe portion 1724 to indicate the bias of biased weight 1732. In embodiments, a position of visual indicator 1734 may indicate how much of a bias is caused by biased weight 1732 such that the closer visual indicator 1734 is to a toe end of toe portion 1724, the more biased biased weight 1732 is toward the toe end of toe portion 1724. As another example, the closer visual indicator 1734 is toward through bore 1714, the less biased biased weight 1732 is toward toe end of toe portion 1724.

Figure 18:
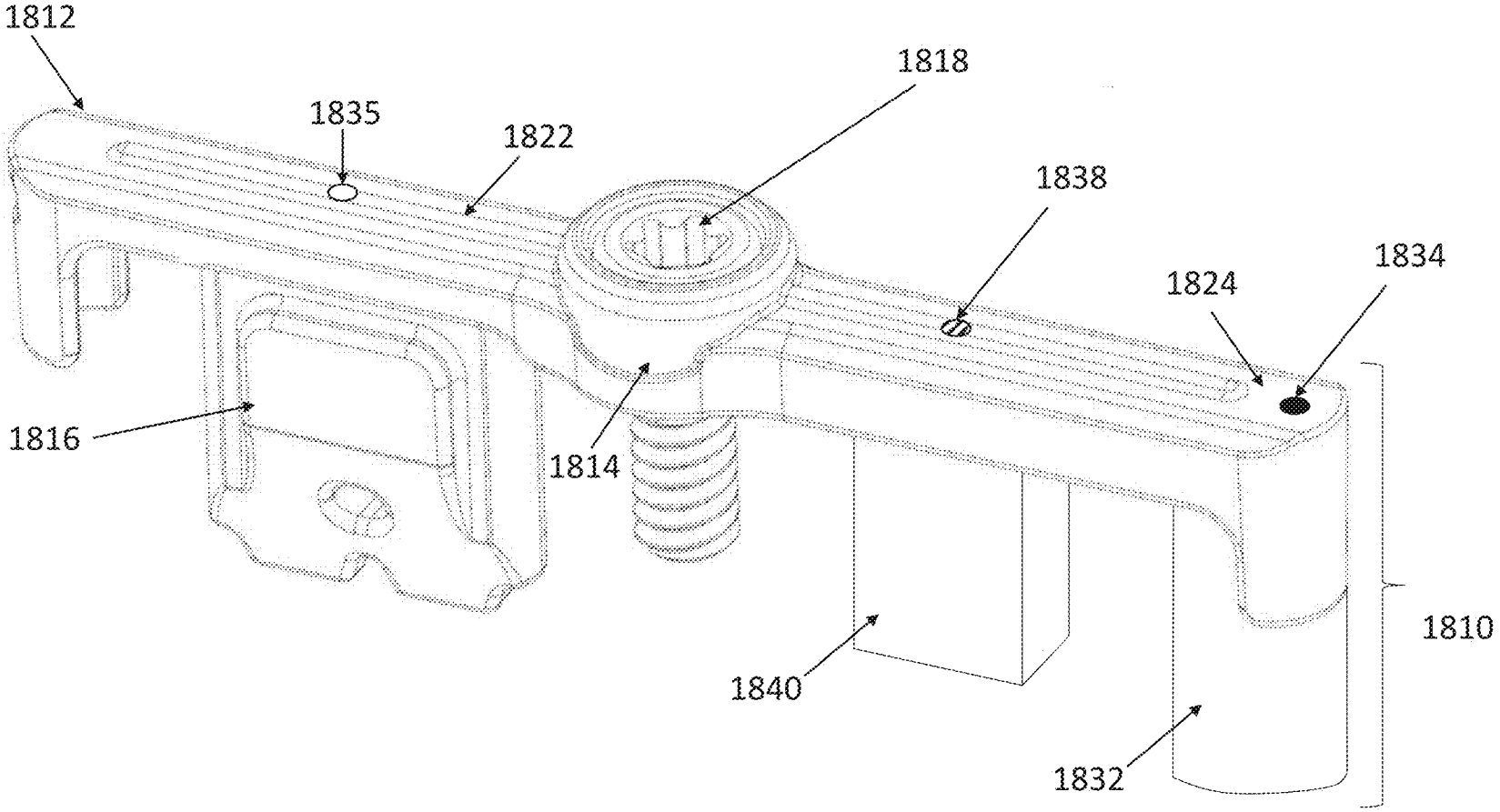
FIG. 18 of the accompanying drawings shows a perspective view of the weight assembly in accordance with an embodiment of the present invention.

FIG. 18 of the accompanying drawings shows a perspective view of the weight assembly 1810 in accordance with an embodiment of the present invention. FIG. 18 illustrates components that may be the same or substantially similar to components illustrated in FIG. 16. Weight assembly 1810 may include movable weights 1816, 1840. Position of movable weight 1816 may be indicated by visual indicator 1835 in a second color. Position of weight 1840 may be indicated by visual indicator 1838 in a third color. Movable weight 1840 may be the same weight as movable weight 1816. In embodiments, movable weight 1840 may be a different weight than movable weight 1816. In some embodiments, movable weight 1840 may be a different material than movable weight 1816, such as, for example, plastic, metal, composite, and/or other materials without departing from the spirit and scope of the presently disclosed technology as set forth in the claims. Biased weight 1832 may be indicated by visual indicator 1834 in a first color.

As illustrated, there are no openings (e.g., heel opening or toe opening) in cover 1812 other than through bore 1814. As discussed herein, it should be appreciated that there are embodiments that have one opening or multiple openings (e.g., through bores, openings like heel opening and toe opening described herein, openings along side walls, or other types of openings) without departing from the spirit and scope of the presently disclosed technology as set forth in the claims. For example, there may be through holes at the positions of visual indicators 1835 and 1838, and movable weights 1816 and 1840 may have protrusions that can be removably inserted into these holes to secure movable weights 1816 and 1840 to cover 1812. The tops of these protrusions may have different colors to indicate a position of each weight when secured to cover 1812.

Figure 19:
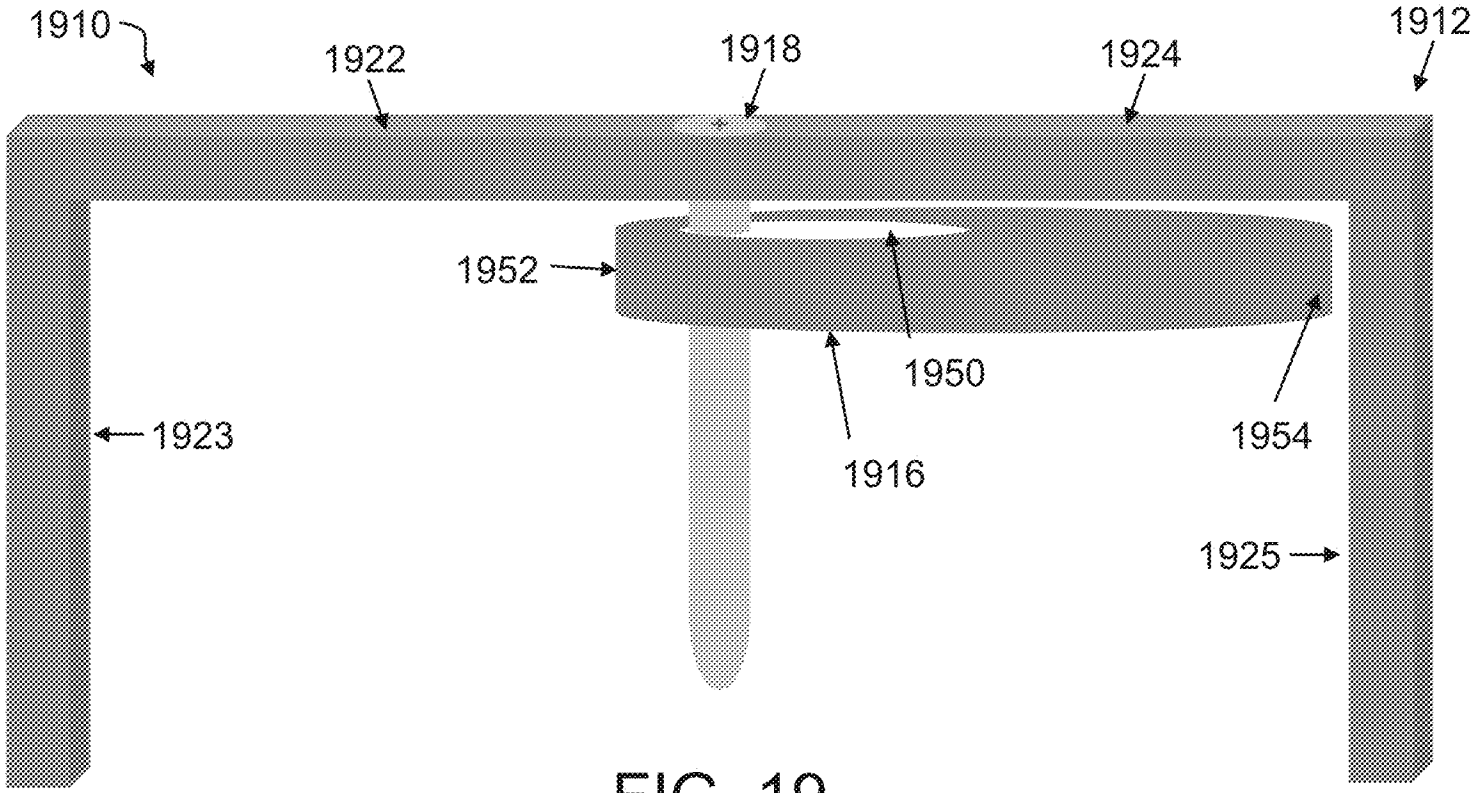
FIG. 19 of the accompanying drawings shows a perspective view of the weight assembly in accordance with an embodiment of the present invention.

FIG. 19 of the accompanying drawings shows a perspective view of the weight assembly 1910 in accordance with an embodiment of the present invention. While there is some height gap illustrated between cover 1912 and adjustable weight 1916, it should be appreciated that this is for the purposes of clarity and the height gap between these two components may be reduced. Weight assembly 1910 may include cover 1912, adjustable weight 1916, and fastener 1918. Weight assembly 1910 may be inserted into a rear cavity (at least shown as 208, 1108, 1308, 1508, 2708, and 2808 in FIGS. 2, 11, 13, 15, 27, and 28, respectively). Cover 1912 may include first portion 1922, second portion 1924, and through bore (at least shown as 2014 in FIG. 20). First portion 1922 may include first leg 1923. First portion 1922 may include a set of first portion dimensions, including a first portion length, which references a dimension from a left to a right of cover 1912, a first portion width, which references a dimension from a back to a front of cover 1912, and a first portion height, which references a dimension from a bottom to a top of cover 1912. First leg 1923 may include a set of first leg dimensions, including a first leg length, a first leg width, and a first leg height, corresponding to the same reference directions as the first portion dimensions. Second portion 1924 may include a second leg 1925. Second portion 1924 may include a set of second portion dimensions, including a second portion length, a second portion width, and a second portion height, corresponding to the same reference directions as the first portion dimensions. Second leg 1925 may include a set of second leg dimensions, including a length, a width, and a height, corresponding to the same reference directions as the first portion dimensions. In some embodiments, the first portion dimensions may be the same as the second portion dimensions.

In embodiments, the first portion dimensions may be different from the second portion dimensions. For example, a first portion width may continually get smaller until first portion 1922 reaches second portion 1924, and the second portion width may continually get smaller until the end of second portion 1924, and the end of the second portion width may be less than about seventy-five percent of the end of the first portion width. In this example, first leg 1923 and second leg 1925 may have shapes and/or dimensions corresponding to first portion 1922 and second portion 1924, respectively. From a top-down view, cover 1912 may appear asymmetric, as will be described in greater detail in FIG. 29. It should be appreciated that other shapes may be used without departing from the spirit and scope of the presently disclosed technology.

In some embodiments, cover 1912 may be weight-biased, that is first portion 1922 of cover 1912 may be heavier than second portion 1924 of cover 1912. In some embodiments, first portion dimensions may be larger than second portions dimensions, causing a weight-bias toward first portion 1922. In some embodiments, cover 1912 may include one or more materials. For example, cover 1912 may include a first material and a second material. The first material may be denser than the second material. It should be appreciated that cover 1912 may be a unitary piece that includes multiple materials. First portion 1922 and/or first leg 1923 may include the first material, and second portion 1924 and/or second leg 1925 may include the second material. A location of the first material and the second material along cover 1912 may affect the CG of the golf club head when cover 1912 is installed. In some embodiments, the first material may be metal, composite, and/or plastic. The second material may be metal, composite, and/or plastic. In one example, the first material may be metal, and the second material may be composite or plastic. In another example the first material may be a denser metal and the second material may be a less dense metal. The metal may include tungsten, steel, titanium, aluminum, scandium, zinc, nickel, copper, iron, alloys, and/or other metals without departing from the spirit and scope of the presently disclosed technology. The composite may include a variety of materials known to those skilled in the art, including for example, graphite, carbon fiber, resins, ceramics, boron fiber, polymers, foams, and/or other composites. The plastic may include thermosets, thermoplastics, and/or other plastics. It should be appreciated that, in some embodiments, cover 1912 may be weight-neutral.

In some embodiments, the first material may be located substantially on first portion 1922, and the second material may be located substantially on the second portion. In embodiments, the first material may be located substantially on a top of cover 1912, a bottom of cover 1912, a front of cover 1912, a back of cover 1912, or on second portion 1924. In embodiments, the second material may be located substantially on the bottom of cover 1912, the top of cover 1912, the back of cover 1912, the front of cover 1912, or on first portion 1922. It should be appreciated that the first material may be positioned in a combination of all three locations, the top, the front, and first portion 1922, or degrees of these three, or their opposites, without departing from the spirit and scope of the presently disclosed technology. In embodiments, substantially on first portion 1922, second portion 1924, the top, the bottom, the front, or the back may mean the material or the material's weight distribution is at or greater than fifty percent toward the identified direction. In some embodiments, substantially may mean at or greater than seventy-five percent, ninety percent, or higher, or anywhere in between without departing from the spirit and scope of the presently disclosed technology.

Adjustable weight 1916 may include opening 1950, first end 1952, and second end 1954. Adjustable weight 1916 may include a set of adjustable weight dimensions, including an adjustable weight length, an adjustable weight width, and an adjustable weight height, corresponding to the same reference directions as the first portion dimensions. Opening 1950 may be at least a fastener length of a body of fastener 1918. Opening 1950 may include a set of opening dimensions, including an opening length, an opening width, and an opening height, corresponding to the same reference directions as the first portion dimensions. Opening 1950 may include a first end opening, the left-most end as illustrated, and a second end opening, the right-most end as illustrated. In some embodiments, there may be multiple openings. For example, there may be three openings along the adjustable weight length. In another example, there may be two openings, one along a top-down axis and another along a front to back or left to right axis.

Fastener 1918 may include a set of fastener dimensions, including a fastener length, a fastener width, and a fastener height, corresponding to the same reference directions as the first portion dimensions. In some embodiments, an opening length may be greater than a fastener length. This greater opening length may allow adjustable weight 1916 to horizontally slide along the opening length to adjust a CG of the golf club head along an x-axis. In embodiments, sliding adjustable weight 1916 along length of opening 1950 may affect the CG of the golf club head along an x-axis between about 0 mm to about 15 mm. In some embodiments, sliding adjustable weight 1916 along length of opening 1950 may affect the CG of the golf club head along an x-axis between about 0 mm to about 5 mm. In embodiments, swiveling adjustable weight 1916 may affect the CG of the golf club head along an x-axis between about 5 mm to about 30 mm. Swiveling may include rotating adjustable weight 1916 180 degrees. In some embodiments, swiveling adjustable weight 1916 may affect the CG of the golf club head along an x-axis between about 10 mm to about 20 mm. As illustrated, adjustable weight 1916 may be in a first position, which may be where second end 1954 is near second leg 1925.

Adjustable weight 1916 may be able to vertically slide along a fastener height to adjust a CG of the golf club head along a y-axis. In embodiments, sliding adjustable weight 1916 along fastener height may affect the CG of the golf club head along a y-axis between about 0 mm to about 15 mm. In some embodiments, sliding adjustable weight 1916 along fastener height may affect the CG of the golf club head along a y-axis between about 0 mm to about 5 mm. As illustrated, in the first position, adjustable weight 1916 may be near cover 1912. In some embodiments, opening 1950 may be threaded. Threaded opening 1950 may fix adjustable weight 1916 into a position and/or help align adjustable weight 1916. In embodiments, opening 1950 may include grooves. Grooves may fix adjustable weight 1916 into a position and/or help align adjustable weight 1916. Fastener 1918 may be threaded. Fastener 1918 may be metal, composite, and/or plastic without departing from the spirit and scope of the presently disclosed technology.

In some embodiments, adjustable weight 1916 may be dimensioned to fit within a rear cavity (at least shown as 208, 1108, 1308, 1508, 2708, and 2808 in FIGS. 2, 11, 13, 15, 27, and 28, respectively). For example, the rear cavity (at least shown as 208, 1108, 1308, 1508, 2708, and 2808 in FIGS. 2, 11, 13, 15, 27, and 28, respectively) may be V-shaped, when viewed along a front to back cut-out, and adjustable weight 1916 may be V-shaped, when viewed along a front to back cut-out, to fit near a top of the rear cavity (at least shown as 208, 1108, 1308, 1508, 2708, and 2808 in FIGS. 2, 11, 13, 15, 27, and 28, respectively). Fastening weight assembly 1910 to the rear cavity (at least shown as 208, 1108, 1308, 1508, 2708, and 2808 in FIGS. 2, 11, 13, 15, 27, and 28, respectively) may cause adjustable weight 1916 to be pressure fit into the rear cavity (at least shown as 208, 1108, 1308, 1508, 2708, and 2808 in FIGS. 2, 11, 13, 15, 27, and 28, respectively). In such embodiments, adjustable weight 1916 may include additional material (not shown) on a top surface to help pressure fit adjustable weight 1916, prevent rattling, and/or prevent other unwanted noise from installed weight assembly 1910. In some embodiments, the additional material (not shown) may be used on a top surface of adjustable weight 1916, a bottom surface of cover 1912, and/or elsewhere on weight assembly 1910. The additional material (not shown) may include padding, foam, rubber, plastic, adhesive, and/or other materials between these components that can be compressed during the installation of the components to prevent movement between the components after being installed. It should be appreciated that the additional material (not shown) may be included as discrete pads at a portion of the contact points between the components or continuous pads around the components.

In some embodiments, adjustable weight 1916 may be weight-biased toward a second end, that is second end 1954 of adjustable weight 1916 may be heavier than first end 1952 of adjustable weight 1916. The weight-bias may be due to opening 1950. That is, there is more material toward second end 1954 than there is compared to first end 1952. In some embodiments, adjustable weight 1916 may include an integrated weight (at least shown as 2256, 2356, 2456, 2556, and 2756 in FIGS. 22, 23, 24, 25, and 27, respectively). The integrated weight (at least shown as 2256, 2356, 2456, 2556, and 2756 in FIGS. 22, 23, 24, 25, and 27, respectively) may cause adjustable weight 1916 to be weight-biased toward second end 1954. In embodiments, adjustable weight 1916 may include one or more materials. For example, adjustable weight 1916 may include a third material and a fourth material. The third material may be denser than the fourth material. It should be appreciated that adjustable weight 1916 may be a unitary piece that includes multiple materials. First end 1952 may include the third material, and second end 1954 may include the fourth material. In some embodiments, second end 1954 may be on an opposite end of first end 1952. A location of the third material and the fourth material along adjustable weight 1916 may affect the CG of the golf club head when adjustable weight 1916 is installed. In some embodiments, the third material may be metal, composite, and/or plastic. The fourth material may be metal, composite, and/or plastic. In one example, the third material may be metal, and the fourth material may be composite or plastic. In another example the third material may be a denser metal and the fourth material may be a less dense metal. In some embodiments, each of the first material, the second material, the third material, and the fourth material may be the same, substantially similar, or different. As used here, substantially may mean the material or the material's weight distribution is at or greater than fifty percent toward the identified direction. In some embodiments, substantially may mean at or greater than seventy-five percent, ninety percent, or higher, or anywhere in between without departing from the spirit and scope of the presently disclosed technology.

As illustrated, first end 1952 is at an opposite side of second end 1954. First end 1952 may be on a left end of adjustable weight 1916 and second end 1954 may be on a right end of adjustable weight 1916. In embodiments, first end 1952 may be on a top, a bottom, a left, a right, a front, and/or a back of adjustable weight 1916. Second end 1954 may be on a bottom, a top, a right, a left, a back, and/or a front of adjustable weight 1916.

Figure 20:
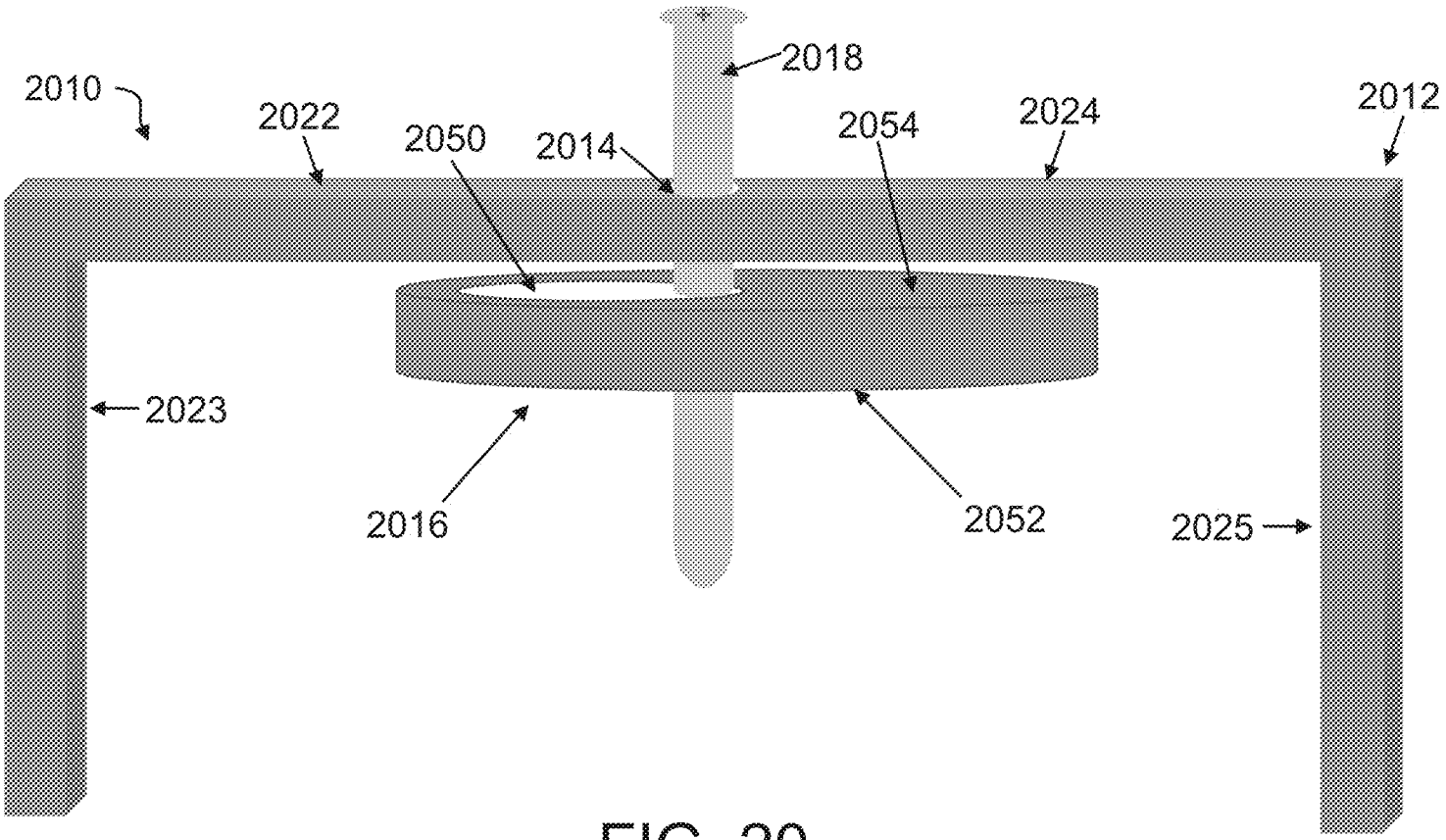
FIG. 20 of the accompanying drawings shows a perspective view of the weight assembly in accordance with an embodiment of the present invention.

FIG. 20 of the accompanying drawings shows a perspective view of the weight assembly 2010 in accordance with an embodiment of the present invention. FIG. 20 illustrates components that may be the same or substantially similar to components illustrated in FIG. 19. For example, weight assembly 1910, cover 1912, adjustable weight 1916, fastener 1918, first portion 1922, first leg 1923, second portion 1924, second leg 1925, opening 1950, first end 1952, and/or second end 1954 may be the same as or substantially similar to weight assembly 2010, cover 2012, adjustable weight 2016, fastener 2018, first portion 2022, first leg 2023, second portion 2024, second leg 2025, opening 2050, first end 2052, and/or second end 2054. While there is some height gap illustrated between cover 2012 and adjustable weight 2016, it should be appreciated that this is for the purposes of clarity and the height gap between these two components may be reduced. Fastener 2018 may be in a partially unfastened state, revealing through bore 2014 separating first portion 2022 from second portion 2024. As illustrated, adjustable weight 2016 may be in a second position by sliding adjustable weight 2016 to the left from the first position. This may cause less of a weight-bias toward second portion 2024. Adjustable weight 2016 may be slidable to cause a neutral CG. A neutral CG may refer to the CG if adjustable weight 2016 were removed. In embodiments, adjustable weight 2016 may be dimensioned such that adjustable weight 2016 may be slidable without taking weight assembly 2010 completely out of the rear cavity (at least shown as 208, 1108, 1308, 1508, 2708, and 2808 in FIGS. 2, 11, 13, 15, 27, and 28, respectively). For example, adjustable weight 2016 may have a small enough height, to allow cover 2012 and adjustable weight 2016 to come out without completely unfastening fastener 2018 from the rear cavity (at least shown as 208, 1108, 1308, 1508, 2708, and 2808 in FIGS. 2, 11, 13, 15, 27, and 28, respectively). Adjustable weight 2016 may be removably couplable to cover 2012 to allow adjustable weight 2016 and cover 2012 to come out of rear cavity (at least shown as 208, 1108, 1308, 1508, 2708, and 2808 in FIGS. 2, 11, 13, 15, 27, and 28, respectively) together.

Figure 21:
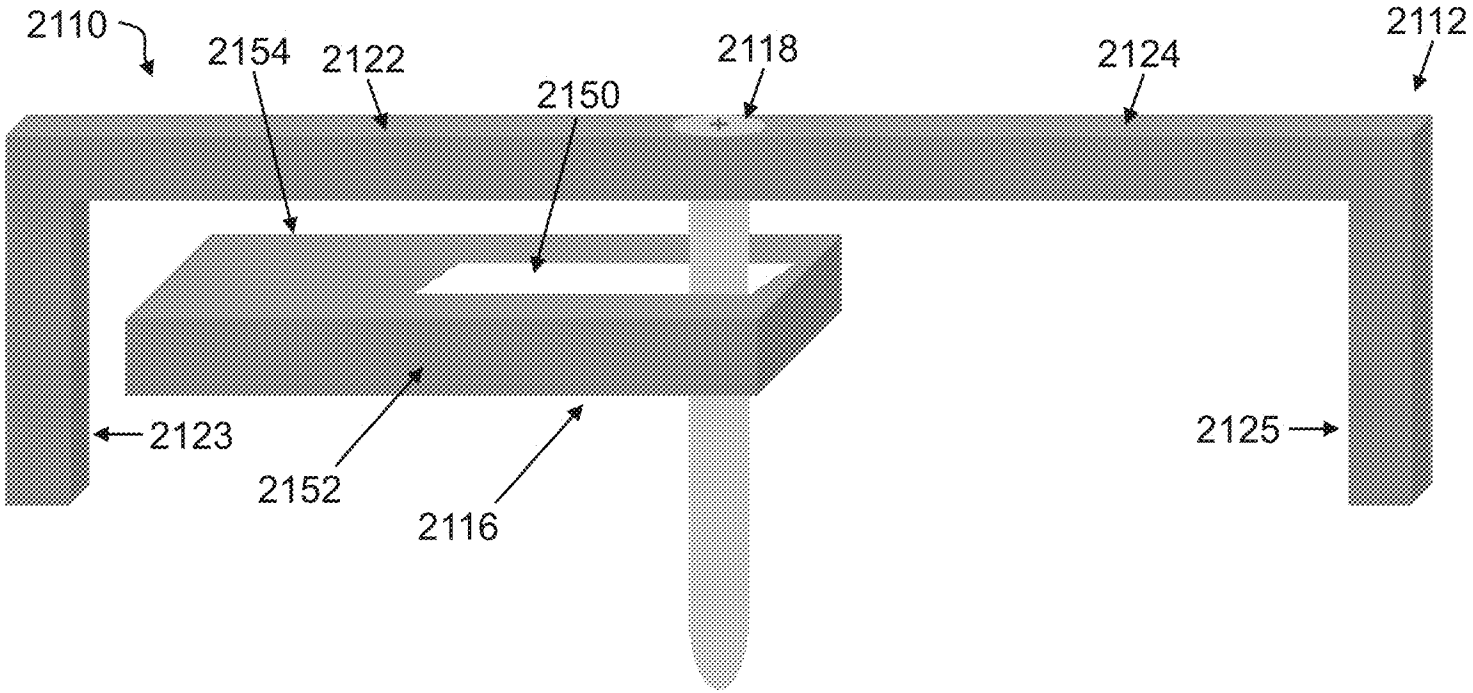
FIG. 21 of the accompanying drawings shows a perspective view of the weight assembly in accordance with an embodiment of the present invention.

FIG. 21 of the accompanying drawings shows a perspective view of the weight assembly 2110 in accordance with an embodiment of the present invention. FIG. 21 illustrates components that may be the same or substantially similar to components illustrated in FIG. 19. For example, weight assembly 1910, cover 1912, fastener 1918, first portion 1922, first leg 1923, second portion 1924, second leg 1925, first end 1952, and/or second end 1954 may be the same as or substantially similar to weight assembly 2110, cover 2112, adjustable weight 2116, fastener 2118, first portion 2122, first leg 2123, second portion 2124, second leg 2125, opening 2150, first end 2152, and/or second end 2154. While there is some height gap illustrated between cover 2112 and adjustable weight 2116, it should be appreciated that this is for the purposes of clarity and the height gap between these two components may be reduced. Adjustable weight 2116 may be rectangular. In some embodiments, it may be, triangular, pyramidal, trapezoidal, and/or any other shape. In embodiments, adjustable weight 2116 may be shaped and/or dimensioned to fit within a rear cavity (at least shown as 208, 1108, 1308, 1508, 2708, and 2808 in FIGS. 2, 11, 13, 15, 27, and 28, respectively) and/or under cover 2112.

Opening 2150 may also be shaped and/or dimensioned differently than adjustable weight 2116, though, in some embodiments, opening 2150 may be shaped and/or dimensioned to match adjustable weight 2116, as illustrated. In some embodiments, first portion 2122, first leg 2123, second portion 2124, and second leg 2125 may be smaller or larger. In embodiments, first portion 2122, first leg 2123, second portion 2124, and second leg 2125 may each have different dimensions. First portion 2122, first leg 2123, second portion 2124, and second leg 2125 may be dimensioned corresponding to rear cavity (at least shown as 208, 1108, 1308, 1508, 2708, and 2808 in FIGS. 2, 11, 13, 15, 27, and 28, respectively). Fastener 2118 may be shaped and/or dimensioned differently than other components discussed herein, though, in some embodiments, fastener 2118 may be shaped and/or dimensioned to match other components. As discussed herein, adjustable weight 2116 and cover 2212 may include one or more materials. Similarly, fastener 2118 may include one or more materials, which have been discussed herein with respect to other components.

Figure 22:
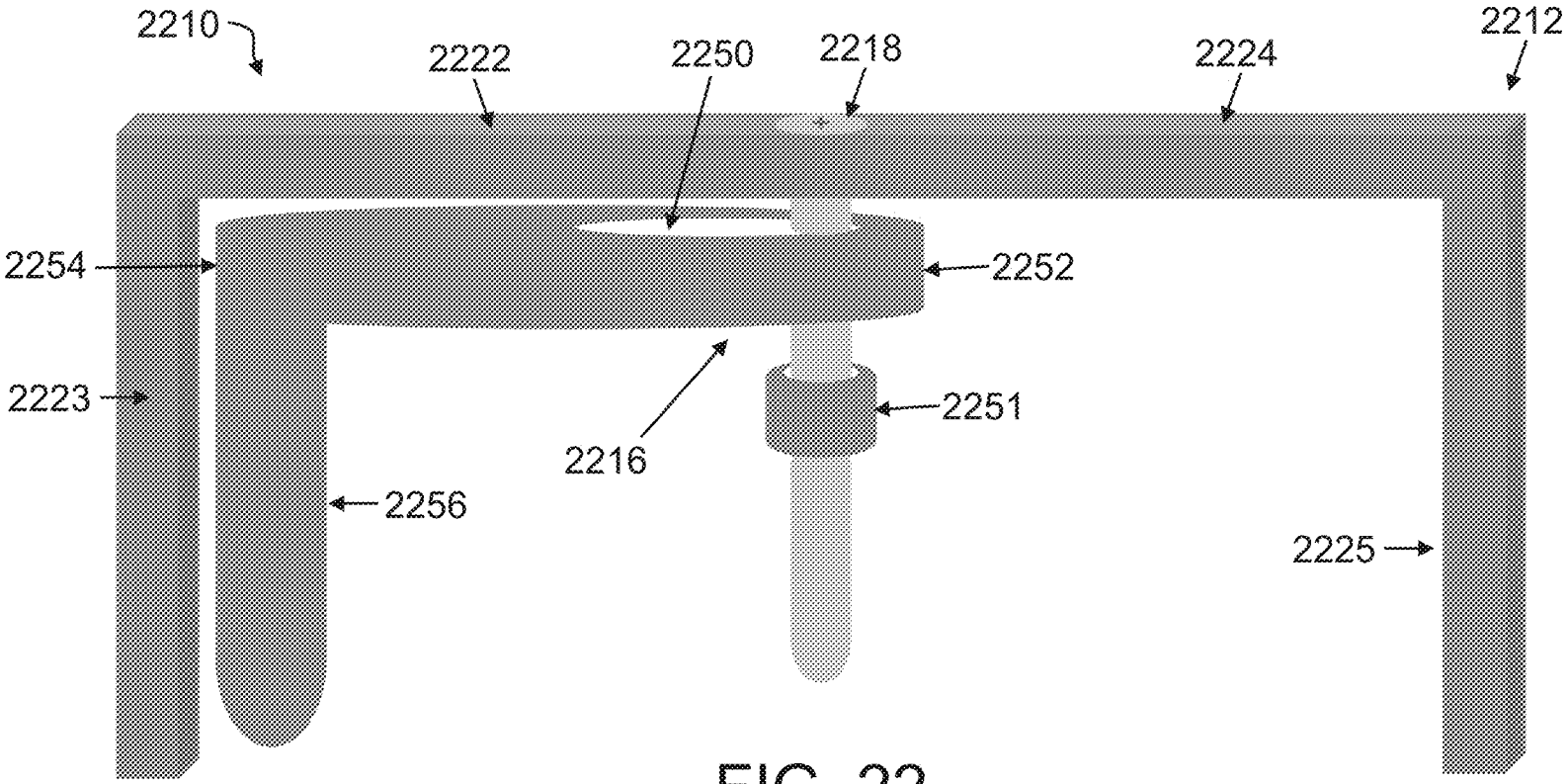
FIG. 22 of the accompanying drawings shows a perspective view of the weight assembly in accordance with an embodiment of the present invention.

FIG. 22 of the accompanying drawings shows a perspective view of the weight assembly 2210 in accordance with an embodiment of the present invention. FIG. 22 illustrates components that may be the same or substantially similar to components illustrated in FIG. 19. For example, weight assembly 1910, cover 1912, fastener 1918, first portion 1922, first leg 1923, second portion 1924, second leg 1925, first end 1952, and/or second end 1954 may be the same as or substantially similar to weight assembly 2210, cover 2212, adjustable weight 2216, fastener 2218, first portion 2222, first leg 2223, second portion 2224, second leg 2225, opening 2250, first end 2252, and/or second end 2254. While there is some height gap illustrated between cover 2212 and adjustable weight 2216, it should be appreciated that this is for the purposes of clarity and the height gap between these two components may be reduced. Weight assembly 2210 may include washer 2251 and integrated weight 2256. Washer 2251 may help secure adjustable weight 2216 in a fixed vertical position. In some embodiments, washer 2251 may be threaded. Washer 2251 may be moved up and down the height of fastener 2218 to adjust the vertical height of adjustable weight 2216. For example, in embodiments without integrated weight 2256 or where a height of integrated weight 2256 is shorter than first leg and second leg, washer 2251 may support weight of adjustable weight 2216 in a vertical position. Washer 2251 may include a set of washer dimensions, including a washer length, a washer width, and a washer height, corresponding to the same reference directions as the first portion dimensions.

In some embodiments, there may be multiple washers. For example, there may be a washer (not shown) between cover 2212 and adjustable weight 2216 and washer 2251 below adjustable weight 2216. In embodiments, an exterior of washer 2251 may engage opening 2250 using a groove-protrusion system, a threaded system, a pressure-fit system, and/or other systems to help secure adjustable weight 2216 to washer 2251. For example, opening 2250 may be dimensioned to fit around washer 2251. In embodiments, a width and/or a length of washer 2251 may be greater than the opening width and/or the opening length. This may prevent adjustable weight 2216 from slipping past washer 2251 without removing washer 2251 first. In some embodiments, washer 2251 may be variously shaped and/or dimensioned, similar to how other components are discussed herein. For example, washer 2251 may extend from its current illustrated position to a bottom of first leg 2223 and second leg 2225. In embodiments, washer 2251 may include one or more materials, which have been discussed herein with respect to other components.

Integrated weight 2256 may be shaped corresponding to cover 2212. In some embodiments, integrated weight 2256 may be variously shaped and/or dimensioned, similar to how other components are discussed herein. For example, integrated weight 2256 may be shorter and/or wider than illustrated. In some embodiments, integrated weight 2256 may be positioned along second end 2254, first end 2252, and/or anywhere in between. As illustrated, integrated weight 2256 may extend perpendicularly away from first end 2252. In some embodiments, there may be multiple integrated weights on adjustable weight 2216. For example, integrated weight 2256 may be extending from second end 2254 and another integrated weight (not shown) may be extending from first end 2252. In embodiments, integrated weights may be on a front side and a back side of opening 2250. In some embodiments, integrated weight 2256 may include one or more materials, which have been discussed herein with respect to other components.

Figure 23:
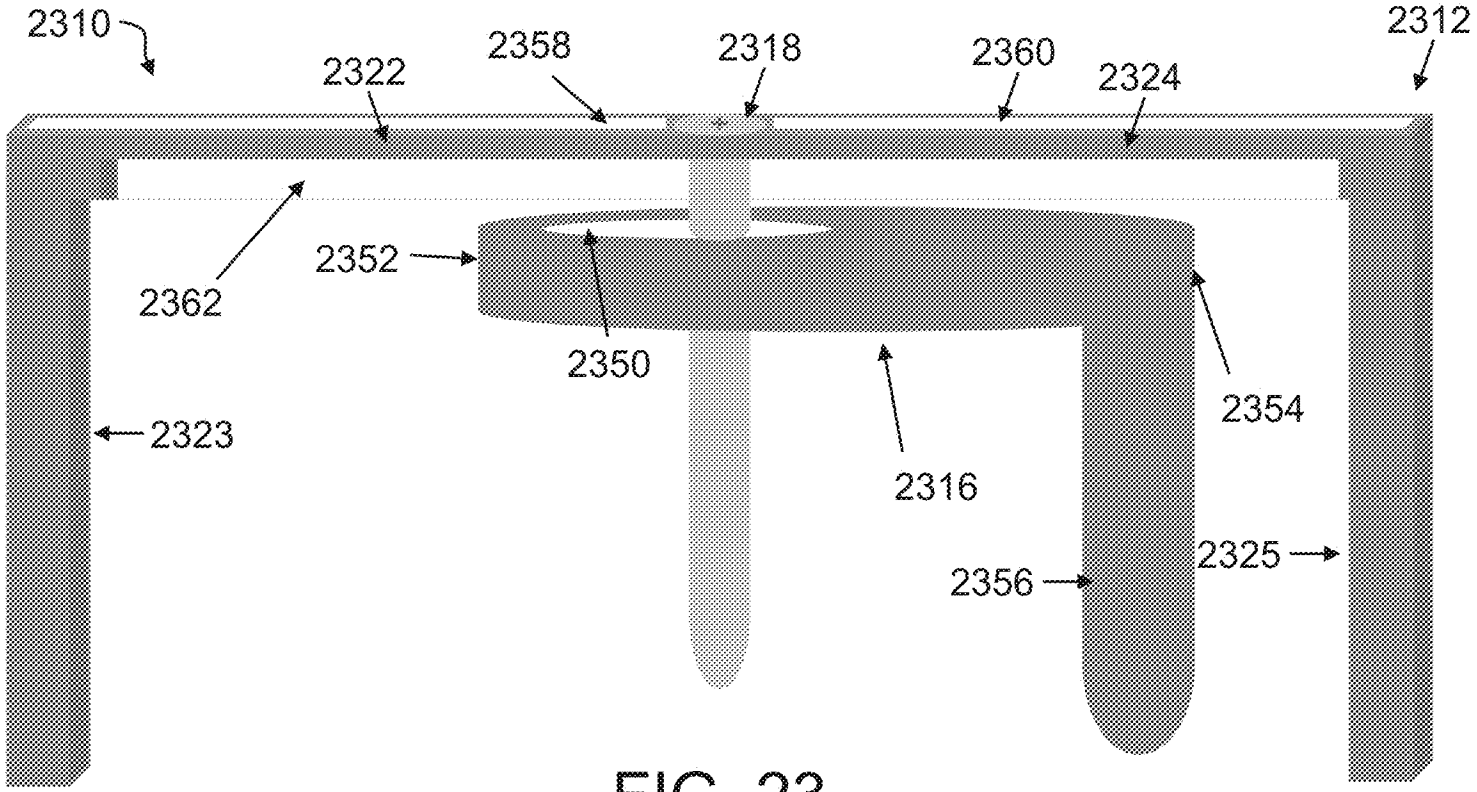
FIG. 23 of the accompanying drawings shows a perspective view of the weight assembly in accordance with an embodiment of the present invention.

FIG. 23 of the accompanying drawings shows a perspective view of the weight assembly 2310 in accordance with an embodiment of the present invention. FIG. 23 illustrates components that may be the same or substantially similar to components illustrated in FIGS. 19 and 22. For example, weight assembly 1910, cover 1912, fastener 1918, first leg 1923, second leg 1925, first end 1952, second end 1954, and/or integrated weight 2256, may be the same as or substantially similar to weight assembly 2310, adjustable weight 2316, fastener 2318, first leg 2323, second leg 2325, opening 2350, first end 2352, second end 2354, and/or integrated weight 2356. While there is some height gap illustrated between cover 2312 and adjustable weight 2316, it should be appreciated that this is for the purposes of clarity and the height gap between these two components may be reduced. Weight assembly 2310 may include cover 2312, first portion 2322, and second portion 2324. Cover 2312 may include slots 2358, 2360 and cut-out 2362. Slots 2358, 2360 may allow a user to view a current position of adjustable weight 2216. Slots 2358, 2360 may run along at least a part of first portion 2322 and/or second portion 2324. In embodiments, slots 2358, 2360 may include windows. The windows may include translucent or transparent material, such as, for example, plastic. Windows may prevent foreign material (e.g., grass, dirt, sand, and so on) from entering the rear cavity (at least shown as 208, 1108, 1308, 1508, 2708, and 2808 in FIGS. 2, 11, 13, 15, 27, and 28, respectively) while still providing a visual indication of adjustable weight 2316. Cut-out 2362 may reduce mass on cover 2312. It should be appreciated that first leg 2323 and second leg 2325 may include slots (not shown) and/or cut-outs (not shown). In some embodiments, slots 2358, 2360 and/or cut-outs 2362 may be used as a visual indicator and/or to reduce weight. Reducing weight in cover 2312 may allow for more discretionary mass to be added to adjustable weight 2316 and/or elsewhere on the golf club head. There may be more slots and cut-outs than illustrated by slots 2358, 2360 and cut-out 2362, which may be variously shaped and/or dimensioned, similar to how other components are discussed herein. In embodiments, slots (not shown) may be located on a rear of body portion, behind at least part of a location of where cover 2312 is installed, allowing a user to view a position of adjustable weight 2316 from a different perspective.

Figure 24:
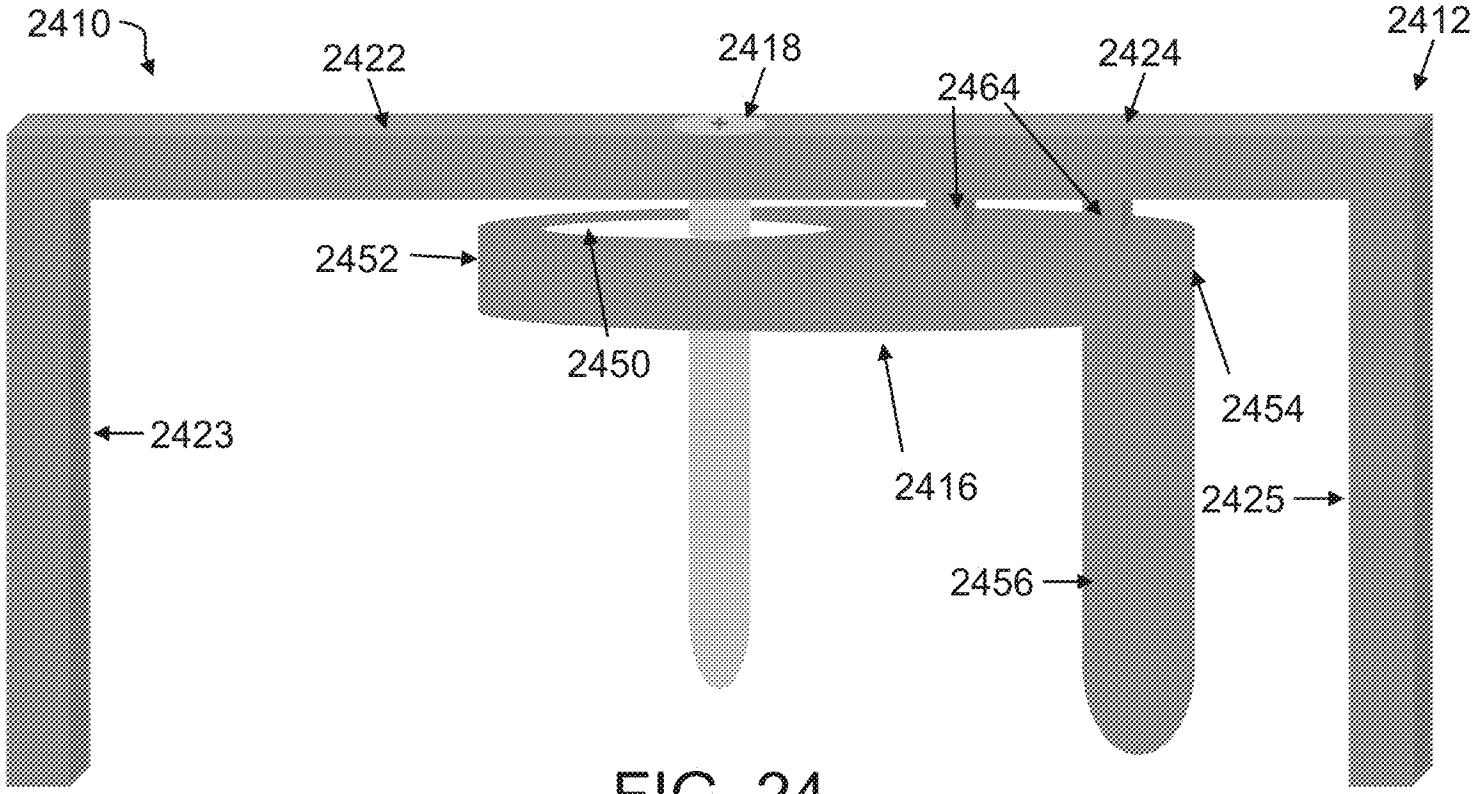
FIG. 24 of the accompanying drawings shows a perspective view of the weight assembly in accordance with an embodiment of the present invention.

FIG. 24 of the accompanying drawings shows a perspective view of the weight assembly 2410 in accordance with an embodiment of the present invention. FIG. 24 illustrates components that may be the same or substantially similar to components illustrated in FIGS. 19 and 22. For example, weight assembly 1910, cover 1912, fastener 1918, first portion 1922, first leg 1923, second portion 1924, second leg 1925, first end 1952, second end 1954, and/or integrated weight 2256, may be the same as or substantially similar to weight assembly 2410, adjustable weight 2416, fastener 2418, first portion 2422, first leg 2423, second portion 2424, second leg 2425, opening 2450, first end 2452, second end 2454, and/or integrated weight 2456. While there is some height gap illustrated between cover 2412 and adjustable weight 2416, it should be appreciated that this is for the purposes of clarity and the height gap between these two components may be reduced. Adjustable weight 2416 may include protrusions 2464. Protrusions 2464 may engage recesses (at least shown as 2566, 2568, 2666, 2668, 2866, and 2868 in FIGS. 25, 26, and 28). Protrusions 2464 may include a set of protrusion dimensions, including a protrusion length, a protrusion width, and a protrusion height, corresponding to the same reference directions as the first portion dimensions. The protrusion-recess system may help secure adjustable weight 2416 into a position along an x-axis. While two protrusions 2464 are illustrated, it should be appreciated that there may be one protrusion or more than two protrusions without departing from the spirit and scope of the presently disclosed technology. In some embodiments, protrusions 2464 may be located anywhere on adjustable weight 2416. For example, a first protrusion may be located near first end 2452 and a second protrusion may be located near second end 2454. In embodiments, the first protrusion may be located on a front side of adjustable weight 2416 and the second protrusion may be located on a back side of adjustable weight 2416. Protrusions 2464 may be variously shaped and/or dimensioned, similar to how other components are discussed herein. In embodiments, protrusions 2464 may include one or more materials, which have been discussed herein with respect to other components. In some embodiments, there may be sets of adjustable weight 2416 with protrusions 2464 of different heights may allow a user to change a CG along a y-axis by installing different adjustable weights. In some embodiments, protrusions 2464 may be extendable to allow a user to change a CG along a y-axis by lengthening or shortening extendable protrusions 2464. In some embodiments, protrusions 2464 may be compatible with slots (at least shown as 2358, 2360 in FIG. 23) and/or cut-outs (at least shown as 2362 in FIG. 23). Protrusions 2464 may be shaped and/or dimensioned to fit within slots (at least shown as 2358, 2360 in FIG. 23) and slide along slots (at least shown as 2358, 2360 in FIG. 23). Protrusions 2464 may include one or more materials, which have been discussed herein with respect to other components.

Figure 25:
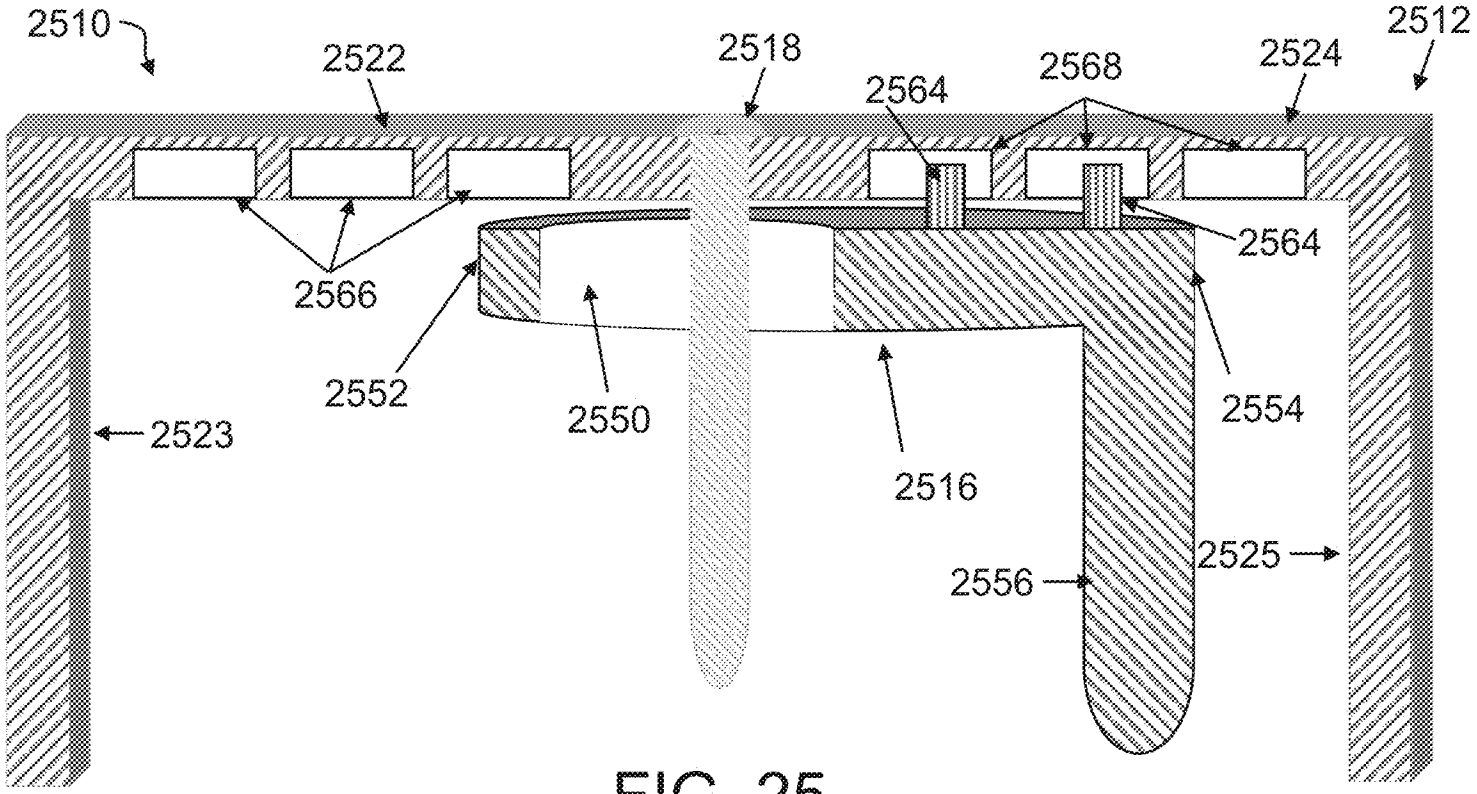
FIG. 25 of the accompanying drawings shows a cross sectional view of the weight assembly in accordance with an embodiment of the present invention.

FIG. 25 of the accompanying drawings shows a cross sectional view of the weight assembly 2510 in accordance with an embodiment of the present invention. FIG. 25 illustrates components that may be the same or substantially similar to components illustrated in FIGS. 19, 22, and 24. For example, weight assembly 1910, cover 1912, fastener 1918, first portion 1922, first leg 1923, second portion 1924, second leg 1925, first end 1952, second end 1954, integrated weight 2256, and/or protrusions 2464 may be the same as or substantially similar to weight assembly 2510, adjustable weight 2516, fastener 2518, first portion 2522, first leg 2523, second portion 2524, second leg 2525, opening 2550, first end 2552, second end 2554, integrated weight 2556, and/or protrusions 2564. While there is some height gap illustrated between cover 2512 and adjustable weight 2516, it should be appreciated that this is for the purposes of clarity and the height gap between these two components may be reduced. As illustrated, the cut-out view may be sliced near a middle of a depth of weight assembly 2510. Cover 2512 may include recesses 2566, 2568. Recesses 2566, 2568 may include a set of recess dimensions, including a recess length, a recess width, and a recess height, corresponding to the same reference directions as the first portion dimensions. In embodiments, recesses 2566 may be symmetrical along an x-axis with recesses 2568. In some embodiments, recesses 2566 may not be symmetrical along an x-axis with recesses 2568. Symmetry may be based on a number of protrusions 2564, positions of protrusions 2564, and/or other characteristics of adjustable weight 2516. While six recesses 2566, 2568 may be illustrated, it should be appreciated that there may be more or fewer recesses 2566, 2568 having different shapes and/or dimensions, similar to how other components are discussed herein. For example, there may be one recess 2566 and one recess 2568 that extends along the length of the three recesses 2566 and three recesses 2568, respectively. In some embodiments, recesses 2566, 2568 may be shaped and/or dimensioned to fit with protrusions 2564.

Figure 26:
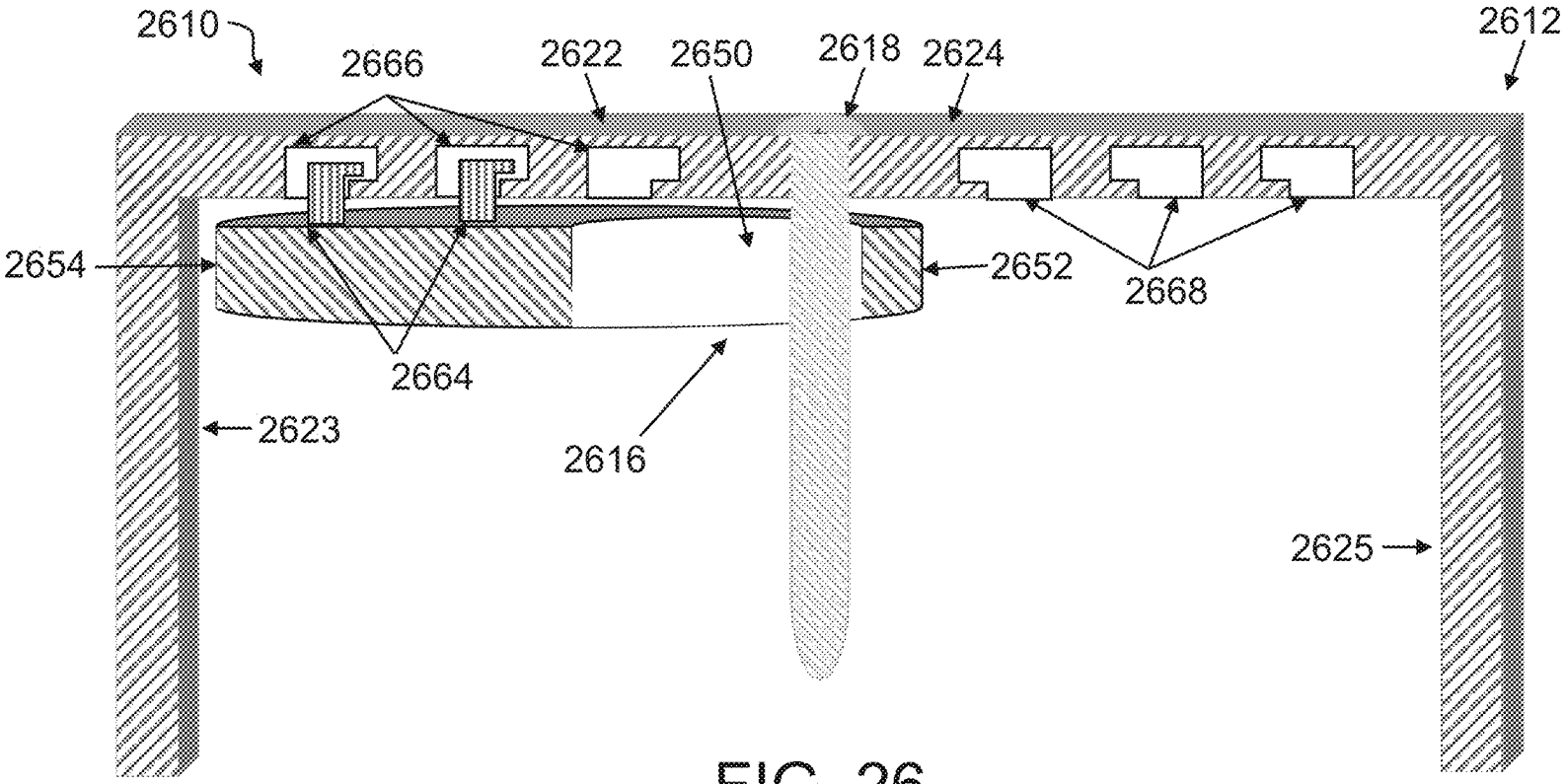
FIG. 26 of the accompanying drawings shows a cross sectional view of the weight assembly in accordance with an embodiment of the present invention.

FIG. 26 of the accompanying drawings shows a cross sectional view of the weight assembly 2610 in accordance with an embodiment of the present invention. FIG. 26 illustrates components that may be the same or substantially similar to components illustrated in FIGS. 19 and 22. For example, weight assembly 1910, cover 1912, fastener 1918, first portion 1922, first leg 1923, second portion 1924, second leg 1925, first end 1952, second end 1954, and/or integrated weight 2256 may be the same as or substantially similar to weight assembly 2610, adjustable weight 2616, fastener 2618, first portion 2622, first leg 2623, second portion 2624, second leg 2625, opening 2650, first end 2652, and/or second end 2654. While there is some height gap illustrated between cover 2612 and adjustable weight 2616, it should be appreciated that this is for the purposes of clarity and the height gap between these two components may be reduced. As illustrated, the cut-out view may be sliced near a middle of a depth of weight assembly 2610. Cover 2512 may include recesses 2666, 2668. Recesses 2666, 2668 may include undercuts. Protrusions 2564 may be shaped to sit on the undercut. As illustrated, each of the protrusions 2564 may have a length shorter than the opening dimension of recesses 2666, 2668 to allow adjustable weight 2616 to be removably secured to cover 2612. While undercuts may extend along a cover length, in some embodiments, undercuts may be positioned along a cover depth.

Similar to the recesses 2566, 2568, in embodiments, recesses 2666 may be symmetrical along an x-axis with recesses 2668. In some embodiments, recesses 2666 may not be symmetrical along an x-axis with recesses 2668. Symmetry may be based on a number of protrusions 2664, positions of protrusions 2664, and/or other characteristics of adjustable weight 2616. While six recesses 2666, 2668 may be illustrated, it should be appreciated that there may be more or fewer recesses 2566, 2568 that are variously shaped and/or dimensioned, similar to how other components are discussed herein. For example, there may be one recess 2566 and one recess 2568 that extends along the length of the three recesses 2566 and three recesses 2568, respectively. In some embodiments, recesses 2566, 2568 may be shaped and/or dimensioned to protrusions 2564. Undercuts may fully secure adjustable weight 2616 into the various positions. It should be appreciated that other mechanisms may be used to help secure adjustable weight 2616 to cover 2612.

Figure 27:
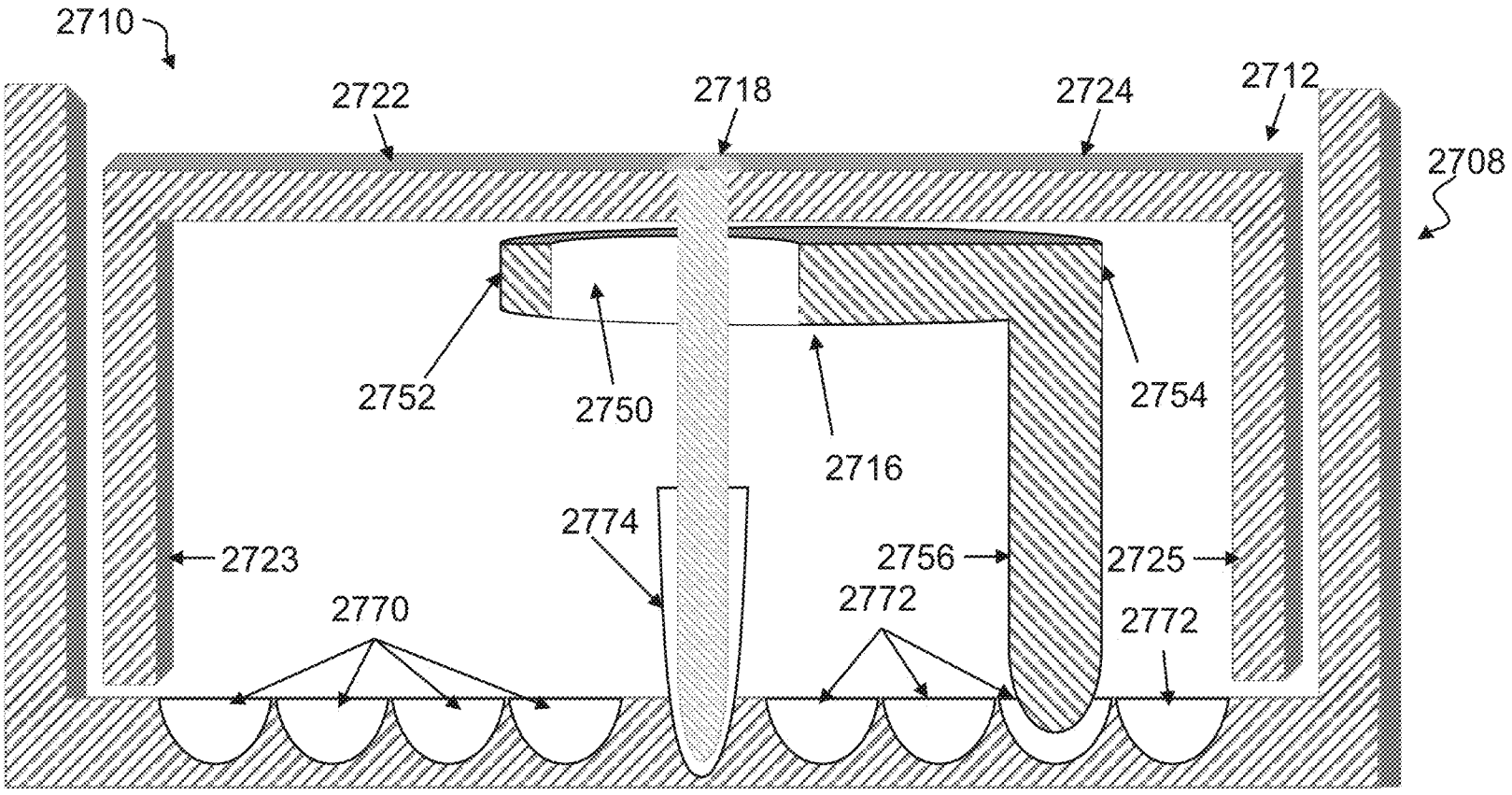
FIG. 27 of the accompanying drawings shows a cross sectional view of the weight assembly and the rear cavity in accordance with an embodiment of the present invention.

FIG. 27 of the accompanying drawings shows a cross sectional view of weight assembly 2710 and rear cavity 2708 in accordance with an embodiment of the present invention. FIG. 27 illustrates components that may be the same or substantially similar to components illustrated in FIGS. 19 and 22. For example, weight assembly 1910, cover 1912, fastener 1918, first portion 1922, first leg 1923, second portion 1924, second leg 1925, first end 1952, second end 1954, and/or integrated weight 2256 may be the same as or substantially similar to weight assembly 2710, adjustable weight 2716, fastener 2718, first portion 2722, first leg 2723, second portion 2724, second leg 2725, opening 2750, first end 2752, second end 2754, and/or integrated weight 2756. While there is some height gap illustrated between cover 2712 and adjustable weight 2716, it should be appreciated that this is for the purposes of clarity and the height gap between these two components may be reduced. As illustrated, the cut-out view may be sliced near a middle of a depth of weight assembly 2710. While there is some length gap illustrated between weight assembly 2710 and rear cavity 2708, it should be appreciated that this is for the purposes of clarity and the length gap between these two components may be reduced. Rear cavity 2708 may include rear recesses 2770, 2772 and protruded bore 2774. In embodiments, rear recesses 2770 may be symmetrical along an x-axis with recesses 2772. In some embodiments, recesses 2770 may not be symmetrical along an x-axis with recesses 2772. Symmetry may be based on a number of integrated weights 2756, positions of integrated weight 2756, and/or other characteristics of adjustable weight 2516. While eight recesses 2770, 2772 may be illustrated, it should be appreciated that there may be more or fewer recesses 2770, 2772 that are variously shaped and/or dimensioned, similar to how other components are discussed herein. In some embodiments, a bottom of integrated weight 2756 may include a slot or groove similar to weight (at least shown as 1516 in FIG. 15) and corresponding protrusions (at least shown as 1509 in FIG. 15) in rear cavity (at least shown as 1508 in FIG. 15), though it should be appreciated that other systems may be used to help fix adjustable weight 2716 into a position. In some embodiments, recesses 2770, 2772 may be shaped and/or dimensioned to a bottom of integrated weight 2756.

Protruded bore 2774 may be threaded. Protruded bore 2774 may include a set of protruded bore dimensions, including a protruded bore length, a protruded bore width, and a protruded bore height, corresponding to the same reference directions as the first portion dimensions. Protruded bore 2774 may be variously shaped and/or dimensioned, similar to how other components are discussed herein. For example, protruded bore 2774 may extend about half of the height of fastener 2718. Though protruded bore 2774 may be illustrated as longer than the fastener length, protruded bore length may be only slightly longer than fastener length and otherwise fit fastener 2718 to engage fastener 2718. In some embodiments, protruded bore 2774 may not be protruded and may be a bore similar to recesses 2770, 2772.

Figure 28:
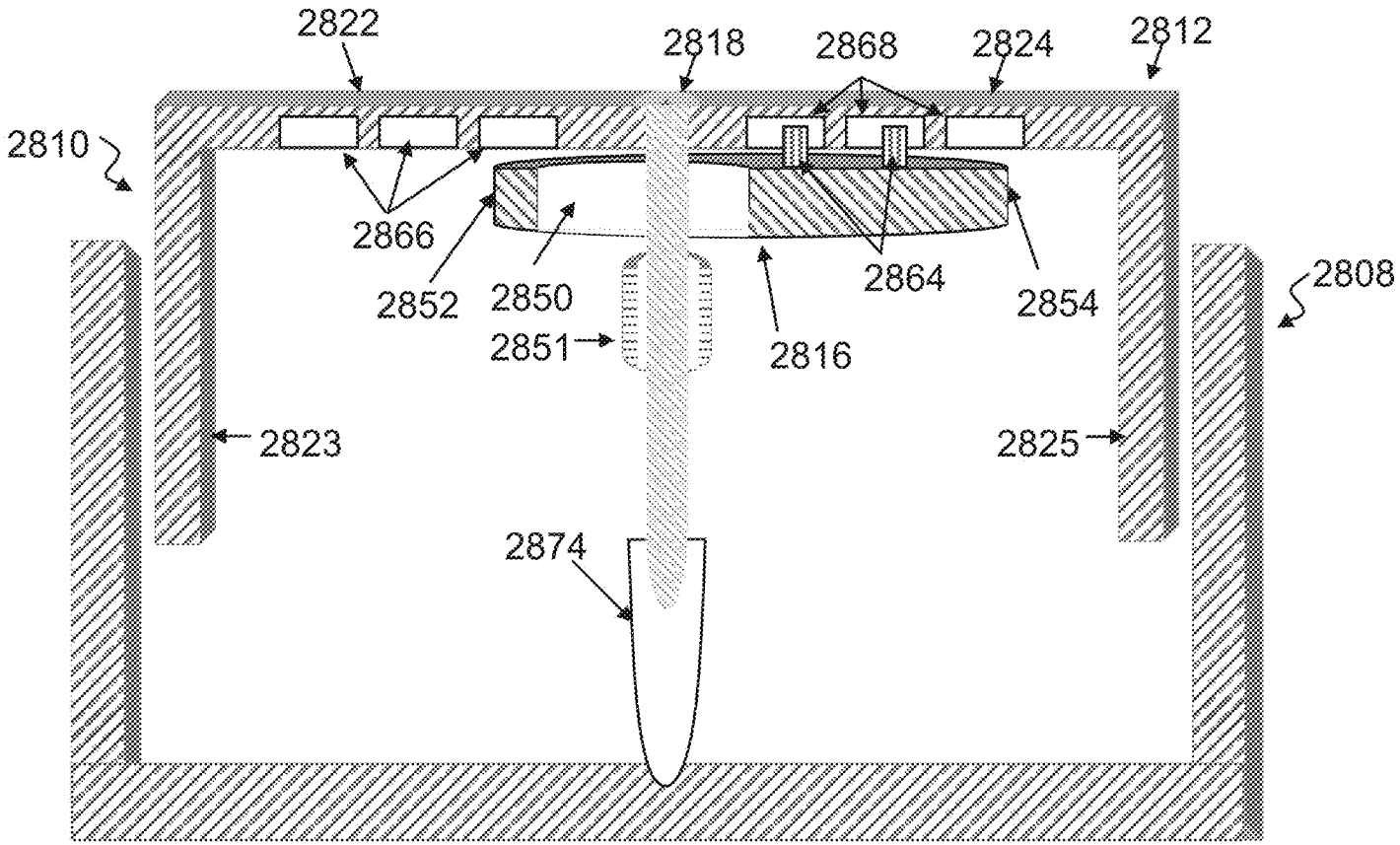
FIG. 28 of the accompanying drawings shows a cross sectional view of the weight assembly and the rear cavity in accordance with an embodiment of the present invention.

FIG. 28 of the accompanying drawings shows a cross sectional view of weight assembly 2810 and rear cavity 2808 in accordance with an embodiment of the present invention. FIG. 28 illustrates components that may be the same or substantially similar to components illustrated in FIGS. 19, 22, 25, and 27. For example, weight assembly 1910, cover 1912, fastener 1918, first portion 1922, first leg 1923, second portion 1924, second leg 1925, first end 1952, second end 1954, washer 2251, integrated weight 2256, protrusions 2564, recesses 2566, 2568, and/or protruded bore 2774 may be the same as or substantially similar to weight assembly 2810, adjustable weight 2816, fastener 2818, first portion 2822, first leg 2823, second portion 2824, second leg 2825, opening 2850, washer 2851, first end 2852, second end 2854, protrusions 2864, recesses 2866, 2868, and/or protruded bore 2874. While there is some height gap illustrated between cover 2812 and adjustable weight 2816, it should be appreciated that this is for the purposes of clarity and the height gap between these two components may be reduced. As illustrated, the cut-out view may be sliced near a middle of a depth of weight assembly 2810. While there is some length gap illustrated between weight assembly 2810 and rear cavity 2808, it should be appreciated that this is for the purposes of clarity and the length gap between these two components may be reduced. As illustrated, weight assembly 2810 may be partially unfastened from a fastened state. Fastener 2818 may be partially engaging protruded bore 2874. In the partially unfastened state, washer 2851 may help secure adjustable weight 2816 into a fixed position along a y-axis, as discussed herein. In the partially unfastened state, a user may horizontally slide and/or swivel adjustable weight 2816. Protrusions 2864 may be lowered below the bottom of recesses 2866, 2868 to allow adjustable weight 2816 to slide a length of opening 2850.

Figure 29:
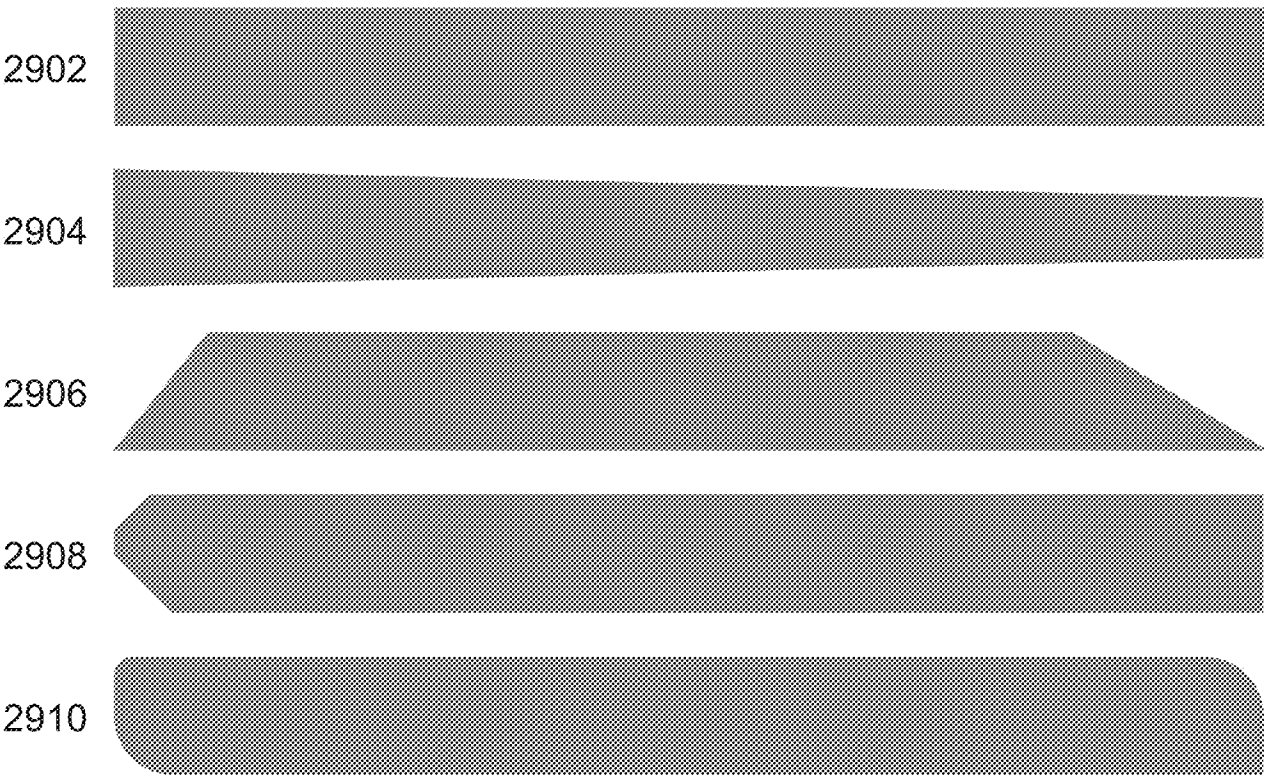
FIG. 29 of the accompanying drawings shows top-down views of the weight assembly in accordance with an embodiment of the present invention.

FIG. 29 of the accompanying drawings shows top-down views of the weight assembly in accordance with an embodiment of the present invention. As alluded to herein, in a top-down view, the cover (at least shown as 1912, 2012, 2112, 2212, 2312, 2412, 2512, 2612, 2712, and 2812 in FIGS. 19, 20, 21, 22, 23, 24, 25, 26, 27, and 28) and other components of the weight assembly (at least shown as 1910, 2010, 2110, 2210, 2310, 2410, 2510, 2610, 2710, and 2810 in FIGS. 19, 20, 21, 22, 23, 24, 25, 26, 27, and 28), including at least adjustable weight (at least shown as 1916, 2016, 2116, 2216, 2316, 2416, 2516, 2716, 2816 in FIGS. 19, 20, 21, 22, 23, 24, 25, 26, 27, and 28) may be variously shaped and/or dimensioned, as discussed herein. In one example, shape 2902 from a top-down view may be rectangular. As illustrated, the shape from a top-down view may be asymmetrical from a top down axis or a left to right axis, including, for example, shape 2904, which may be rectangular and linearly tapered. Shape 2906 may be trapezoidal. A left side of shape 2906 may have a first slope and the right side of the shape 2906 may have a second slope. The second slope may be more gradual than the first slope, that is, the second slope covers the same height over a longer length than the first slope. Shape 2908 may have two linear slopes on a left side and be rectangular on the right side. Shape 2910 may be curved on both sides. The top left side may be a smaller curve than the bottom left side and the top right side. The bottom right side may be rectangular, that is there is a perpendicular corner. The various shapes may correspond to a shape of rear cavity (at least shown as 208, 1108, 1308, 1508, 2708, and 2808 in FIGS. 2, 11, 13, 15, 27, and 28, respectively). A specified shape and/or dimension may provide a uniform appearance to the golf club head, including where the cover is installed and/or inserted. For example, the cover (at least shown as 1912, 2012, 2112, 2212, 2312, 2412, 2512, 2612, 2712, and 2812 in FIGS. 19, 20, 21, 22, 23, 24, 25, 26, 27, and 28) and the weight assembly (at least shown as 1910, 2010, 2110, 2210, 2310, 2410, 2510, 2610, 2710, and 2810 in FIGS. 19, 20, 21, 22, 23, 24, 25, 26, 27, and 28) may fit into, or below, a muscle channel without affecting the visual look of the iron. By allowing for an asymmetric cover as illustrated, the weight assembly (at least shown as 1910, 2010, 2110, 2210, 2310, 2410, 2510, 2610, 2710, and 2810 in FIGS. 19, 20, 21, 22, 23, 24, 25, 26, 27, and 28) may be camouflaged. No lip may be created from the weight assembly (shown as 1910, 2010, 2110, 2210, 2310, 2410, 2510, 2610, 2710, and 2810 in FIGS. 19, 20, 21, 22, 23, 24, 25, 26, 27, and 28) in the installed and/or fastened state, that is, the top surface of the weight assembly (shown as 1910, 2010, 2110, 2210, 2310, 2410, 2510, 2610, 2710, and 2810 in FIGS. 19, 20, 21, 22, 23, 24, 25, 26, 27, and 28) may be flush with the surrounding surface of the golf club head.

The presently disclosed technology may be used to adjust the CG of a golf club head. The adjustable weight may be swivelable from the first portion to the second portion, and vice versa. To help further clarify the swiveling motion, from a top-down view, one end of the adjustable weight may be swiveled, or rotated, in a clockwise and counter-clockwise movement. Depending on how the weight assembly is installed, the rest of the golf club head may prevent complete 360 degree motion of the adjustable weight when the cover is partially installed or inserted. In the partially installed state, or partially unfastened state, a user may be able to adjust the CG without fully removing the cover from the rear cavity. The user may also horizontally slide the adjustable weight along the length of the opening to adjust the CG.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:
- a body portion further comprising:
  - a face;
  - a sole extending rearward from the face;
  - a back portion positioned rearward of the face and extending from a rearward portion of the sole; and
  - a rear cavity formed near the sole;
- a weight assembly further comprising:
  - a cover to cover the rear cavity further comprising:
    - a first portion;
    - a second portion; and
    - a through bore, separating the first portion and the second portion;
  - and
  - an adjustable weight installable underneath the cover, wherein the adjustable weight comprises:
    - a first end adjustably installable near the first portion;
    - a second end adjustably installable near the second portion,
  - wherein the first end is swivelable from near the first portion to near the second portion thereby swiveling the second end from near the second portion to near the first portion; and
    - an opening between the first end and the second end; and
- a fastener to engage the through bore to secure the cover to the body portion, and wherein the fastener engages the opening.

2. The golf club head of claim 1, wherein the opening comprises a first end opening near the first end and a second end opening near the second end, and wherein the adjustable weight is slidable from a first end opening to a second end opening to affect a center of gravity of the golf club head along an x-axis.

3. The golf club head of claim 1, wherein the cover comprises a first material and a second material, wherein the first material is denser than the second material, and wherein the first material is substantially on the first portion.

4. The golf club head of claim 1, wherein a first shape of the first portion is different than a second shape of the second portion.

5. The golf club head of claim 1, wherein the adjustable weight comprises a third material and a fourth material, wherein the third material is denser than the fourth material, and wherein the third material is substantially on the first end.

6. The golf club head of claim 1, wherein the adjustable weight comprises an integrated weight extending perpendicularly away from the first end.

7. The golf club head of claim 6, wherein the rear cavity comprises a rear recess, and wherein the integrated weight fits into the rear recess fixing the adjustable weight into a first position.

8. The golf club head of claim 1, wherein the fastener comprises threads, and wherein the opening comprises grooves corresponding to the threads to allow the adjustable weight to slide along the opening.

9. The golf club head of claim 1, wherein the adjustable weight comprises a protrusion extending toward the cover, wherein the cover comprises a recess, and wherein the protrusion fits into the recess fixing the adjustable weight into a second position.

10. A golf club head comprising:
- a body portion further comprising:
  - a face;
  - a sole extending rearward from the face;

a back portion positioned rearward of the face and extending from a rearward portion of the sole; and a rear cavity formed near the sole;

a weight assembly further comprising:

an asymmetric cover to cover the rear cavity further comprising:

a first portion;

a second portion different from the first portion; and a through bore, separating the first portion and the second portion; and an adjustable weight installable underneath the asymmetric cover, wherein the adjustable weight is swivelable from the first portion to the second portion, and vice versa; and a fastener to engage the through bore to secure the asymmetric cover to the body portion, and wherein the fastener engages the adjustable weight.

11. The golf club head of claim 10, wherein the adjustable weight comprises:

a first end adjustably installable near the first portion;

a second end adjustably installable near the second portion; and an opening between the first end and the second end;

wherein the first end is swivelable from near the first portion to near the second portion thereby swiveling the second end from near the second portion to near the first portion.

12. The golf club head of claim 11, wherein the opening comprises a first end opening near the first end and a second end opening near the second end, and wherein the adjustable weight is slidable from a first end opening to a second end opening to affect a center of gravity of the golf club head along an x-axis between about 0 mm to about 5 mm.

13. The golf club head of claim 11, wherein the adjustable weight is slidable from the asymmetric cover to near a bottom of the fastener to affect a center of gravity of the golf club head along a y-axis between about 0 mm to about 15 mm.

14. The golf club head of claim 10, wherein the adjustable weight comprises an integrated weight extending perpendicularly away from a first end of the adjustable weight.

15. A golf club head comprising:

a body portion further comprising:

a face;

a sole extending rearward from the face;

a back portion positioned rearward of the face and extending from a rearward portion of the sole; and a rear cavity formed near the sole; and a weight assembly further comprising:

a cover to cover the rear cavity, wherein the cover comprises:

a first portion;

a second portion;

a through bore, separating the first portion and the second portion;

a first slot along at least part of the first portion; and a second slot along at least part of the second portion;

wherein the first slot and the second slot provide a visual indication of a position of an adjustable weight; and the adjustable weight installable underneath the cover, wherein the adjustable weight comprises an opening to allow the adjustable weight to swivel and slide into different positions; and a fastener to engage the cover to the body portion, and wherein the fastener is to engage the opening.

16. The golf club head of claim 15, wherein the first portion is a first shape, and wherein the second portion is a second shape that is different than the first shape.

17. The golf club head of claim 7, wherein the adjustable weight comprises:

a first end adjustably installable near the first portion;

a second end adjustably installable near the second portion; and the opening between the first end and the second end, and wherein an opening length is at least a fastener length of the fastener.

* * * * *